US007497623B2

(12) United States Patent
Thomas et al.

(10) Patent No.: US 7,497,623 B2
(45) Date of Patent: Mar. 3, 2009

(54) PACKAGES WITH ACTIVE AGENTS

(75) Inventors: Toby R. Thomas, Pleasant Prairie, WI (US); Steven P. Long, Chatham, IL (US); William P. Belias, Pittsford, NY (US); Nathan A. Kolovich, Round Lake, IL (US)

(73) Assignee: Pactiv Corporation, Lake Forest, IL (US)

( * ) Notice: Subject to any disclaimer, the term of this patent is extended or adjusted under 35 U.S.C. 154(b) by 221 days.

(21) Appl. No.: 11/055,574

(22) Filed: Feb. 10, 2005

(65) Prior Publication Data

US 2005/0220374 A1 Oct. 6, 2005

Related U.S. Application Data

(63) Continuation-in-part of application No. 10/375,188, filed on Feb. 26, 2003, now abandoned.

(60) Provisional application No. 60/543,344, filed on Feb. 10, 2004, provisional application No. 60/543,345, filed on Feb. 10, 2004, provisional application No. 60/359,874, filed on Feb. 27, 2002.

(51) Int. Cl.
*B65D 33/16* (2006.01)
*A44B 19/00* (2006.01)

(52) U.S. Cl. ..... 383/63; 24/585.12

(58) Field of Classification Search ..... 383/63–64; 24/585.12

See application file for complete search history.

(56) References Cited

U.S. PATENT DOCUMENTS 2,544,093 A 3/1951 Kilgore
3,771,254 A 11/1973 Scott et al.
4,009,254 A 2/1977 Renold
4,095,031 A 6/1978 Engle
4,105,144 A 8/1978 Lin (Continued)

FOREIGN PATENT DOCUMENTS

EP 0687 412 12/1995

(Continued)

OTHER PUBLICATIONS

Massey, L., "Film Properties of Plastics and Elastomers—A Guide to Non-Wovens in Packaging Applications", 2004, p. 129.

(Continued)

*Primary Examiner*—Jes F Pascua
(74) *Attorney, Agent, or Firm*—Baker Botts LLP

(57) ABSTRACT

Packages with active agents are described. Generally, the disclosed packages have a pair of opposing body panels joined together along a pair of opposing sides and a bottom bridging the sides so as to define a mouth opposite the bottom, a reclosable fastener extending along the mouth, and an active agent. The reclosable fastener includes a pair of polymeric tracks, in which each of the tracks includes a mating element and a fin portion. The mating elements are releasably engageable to each other, and each of the fin portions extends downwards from the respective mating element towards the bottom of the reclosable package. The active agent is associated with at least one of the fin portions for communication with the interior of the reclosable package.

19 Claims, 8 Drawing Sheets

U.S. PATENT DOCUMENTS

| | | | | |
|---|---|---|---|---|
| 4,186,743 | A | | 2/1980 | Steiger |
| 4,202,472 | A | | 5/1980 | Lin |
| 4,257,176 | A | | 3/1981 | Hartung et al. |
| 4,264,654 | A | | 4/1981 | Okazaki |
| 4,277,024 | A | | 7/1981 | Spector |
| 4,348,455 | A | | 9/1982 | Clayton |
| 4,349,104 | A | | 9/1982 | Hayes |
| 4,407,897 | A | | 10/1983 | Farrell et al. |
| 4,425,410 | A | | 1/1984 | Farrell et al. |
| 4,430,457 | A | | 2/1984 | Dobreski |
| 4,464,443 | A | | 8/1984 | Farrell et al. |
| 4,484,768 | A | | 11/1984 | Norfleet |
| 4,528,226 | A | | 7/1985 | Sweeny |
| 4,555,015 | A | | 11/1985 | Haase |
| 4,558,463 | A | | 12/1985 | Boyd |
| 4,605,165 | A | | 8/1986 | Van Loveren et al. |
| 4,624,654 | A | | 11/1986 | Boyd et al. |
| 4,624,991 | A | | 11/1986 | Haas |
| 4,661,388 | A | | 4/1987 | Charbonneau |
| 4,717,017 | A | | 1/1988 | Sprinkel, Jr. et al. |
| 4,717,070 | A | | 1/1988 | Taub |
| 4,722,815 | A | | 2/1988 | Shibanai |
| 4,726,171 | A | | 2/1988 | Kreager et al. |
| 4,735,803 | A | | 4/1988 | Katz et al. |
| 4,743,249 | A | | 5/1988 | Loveland |
| 4,813,791 | A | | 3/1989 | Cullen et al. |
| 4,817,860 | A | | 4/1989 | Shapiro |
| 4,817,861 | A | | 4/1989 | Henrikson |
| 4,848,929 | A | | 7/1989 | Rawl |
| 4,853,413 | A | | 8/1989 | Katz et al. |
| 4,890,736 | A | | 1/1990 | Johannes |
| 4,944,393 | A | | 7/1990 | Cappuzzo et al. |
| 5,019,212 | A | | 5/1991 | Morita et al. |
| 5,041,317 | A | | 8/1991 | Greyvenstein |
| 5,067,208 | A | | 11/1991 | Herrington et al. |
| 5,098,725 | A | | 3/1992 | Rotman et al. |
| 5,119,968 | A | | 6/1992 | Palmer |
| 5,128,182 | A | | 7/1992 | Bunker et al. |
| 5,157,902 | A | | 10/1992 | Hatakeyma |
| 5,161,688 | A | | 11/1992 | Muchin |
| 5,246,110 | A | | 9/1993 | Greyvenstein |
| 5,246,663 | A | | 9/1993 | Ohama et al. |
| 5,249,676 | A | | 10/1993 | Ashcraft et al. |
| 5,265,961 | A | | 11/1993 | Boyd |
| 5,268,390 | A | | 12/1993 | Kitagawa et al. |
| 5,273,817 | A | | 12/1993 | Kitagawa |
| 5,306,466 | A | | 4/1994 | Goldsmith |
| 5,334,373 | A | | 8/1994 | Sekiyama et al. |
| 5,334,428 | A | | 8/1994 | Dobreski et al. |
| 5,342,420 | A | | 8/1994 | Bosses |
| 5,360,609 | A | | 11/1994 | Wellinghoff |
| 5,391,420 | A | | 2/1995 | Bootman et al. |
| 5,392,590 | A | * | 2/1995 | Ambrose et al. ..... 53/425 |
| 5,407,609 | A | | 4/1995 | Tice et al. |
| 5,439,172 | A | | 8/1995 | Comyn et al. |
| 5,439,648 | A | | 8/1995 | Balderson et al. |
| 5,535,885 | A | | 7/1996 | Daniel et al. |
| 5,554,376 | A | | 9/1996 | Sekiyama et al. |
| 5,556,635 | A | | 9/1996 | Istin et al. |
| 5,556,699 | A | | 9/1996 | Niira et al. |
| 5,562,874 | A | | 10/1996 | Saad et al. |
| 5,566,693 | A | | 10/1996 | Gunderman et al. |
| 5,571,582 | A | | 11/1996 | Katoh |
| 5,596,051 | A | | 1/1997 | Jahns et al. |
| 5,611,627 | A | | 3/1997 | Belias et al. |
| 5,622,263 | A | | 4/1997 | Greenland |
| 5,631,300 | A | | 5/1997 | Wellinghoff |
| 5,650,446 | A | | 7/1997 | Wellinghoff et al. |
| 5,668,185 | A | | 9/1997 | Wellinghoff |
| 5,683,340 | A | | 11/1997 | Belias et al. |
| 5,690,130 | A | | 11/1997 | Gunderman et al. |
| 5,698,250 | A | | 12/1997 | DelDuca et al. |
| 5,703,124 | A | | 12/1997 | Takata et al. |
| 5,709,641 | A | | 1/1998 | Vaquero |
| 5,730,311 | A | | 3/1998 | Curtis |
| 5,736,180 | A | | 4/1998 | Peiffer et al. |
| 5,762,971 | A | | 6/1998 | Schirmer |
| 5,811,142 | A | | 9/1998 | DelDuca et al. |
| 5,833,971 | A | | 11/1998 | Baldwin |
| 5,845,769 | A | * | 12/1998 | Yeager ..... 206/204 |
| 5,880,150 | A | | 3/1999 | Fujita et al. |
| 5,884,801 | A | | 3/1999 | Simpson |
| 5,928,560 | A | | 7/1999 | DelDuca et al. |
| 5,928,661 | A | | 7/1999 | Fujita et al. |
| 5,929,133 | A | | 7/1999 | Watanabe et al. |
| 5,948,457 | A | | 9/1999 | DelDuca et al. |
| 5,954,433 | A | * | 9/1999 | Yeager ..... 383/203 |
| 5,985,303 | A | | 11/1999 | Okada et al. |
| 5,997,178 | A | | 12/1999 | Nye et al. |
| 6,000,926 | A | | 12/1999 | Schirmer |
| 6,046,243 | A | | 4/2000 | Wellinghoff et al. |
| 6,051,388 | A | | 4/2000 | Bodenhamer |
| 6,054,153 | A | | 4/2000 | Carr et al. |
| 6,059,458 | A | | 5/2000 | Belias et al. |
| 6,066,347 | A | | 5/2000 | Prasad et al. |
| 6,077,495 | A | | 6/2000 | Speronello et al. |
| 6,083,611 | A | | 7/2000 | Eichbauer et al. |
| 6,085,930 | A | | 7/2000 | Curtis |
| 6,119,855 | A | | 9/2000 | Yeager et al. |
| 6,132,781 | A | | 10/2000 | Carr et al. |
| 6,147,588 | A | | 11/2000 | Nakayama et al. |
| 6,150,004 | A | * | 11/2000 | Oikawa et al. ..... 428/141 |
| 6,183,790 | B1 | | 2/2001 | DelDuca et al. |
| 6,190,610 | B1 | | 2/2001 | Goldsmith et al. |
| 6,196,960 | B1 | * | 3/2001 | Owensby ..... 493/220 |
| 6,253,710 | B1 | | 7/2001 | Ward et al. |
| 6,257,401 | B1 | | 7/2001 | Mangla et al. |
| 6,315,921 | B1 | | 11/2001 | DelDuca et al. |
| 6,321,509 | B1 | | 11/2001 | DelDuca et al. |
| 6,325,974 | B1 | | 12/2001 | Ahvenainen et al. |
| 6,361,812 | B1 | | 3/2002 | Ekanayake et al. |
| 6,361,962 | B1 | | 3/2002 | Lentini et al. |
| 6,364,097 | B1 | | 4/2002 | Whitaker et al. |
| 6,395,195 | B1 | | 5/2002 | Evans et al. |
| 6,413,595 | B1 | | 7/2002 | Schirmer |
| 6,436,422 | B1 | | 8/2002 | Trogolo et al. |
| 6,479,016 | B1 | | 11/2002 | Goldsmith et al. |
| 6,482,433 | B1 | | 11/2002 | DeRoos et al. |
| 6,489,003 | B1 | * | 12/2002 | Levitt et al. ..... 428/100 |
| 6,491,993 | B1 | | 12/2002 | Forbes et al. |
| 6,494,023 | B2 | | 12/2002 | DelDuca et al. |
| 6,495,368 | B1 | | 12/2002 | Wallach |
| 6,499,878 | B1 | * | 12/2002 | Dobreski et al. ..... 383/5 |
| 6,500,901 | B2 | | 12/2002 | Somers |
| 6,508,955 | B1 | | 1/2003 | Wu et al. |
| 6,558,723 | B2 | | 5/2003 | Ekanayake et al. |
| 6,576,474 | B2 | | 6/2003 | Wallach |
| 6,585,843 | B2 | | 7/2003 | Nickell et al. |
| 6,592,702 | B2 | | 7/2003 | Nickell et al. |
| 6,593,142 | B2 | | 7/2003 | Kelly et al. |
| 6,601,732 | B1 | * | 8/2003 | Rooney et al. ..... 222/107 |
| 6,616,861 | B1 | | 9/2003 | Evans et al. |
| 6,644,494 | B2 | | 11/2003 | Hayes et al. |
| 6,649,090 | B2 | | 11/2003 | Funaki et al. |
| 6,656,303 | B1 | | 12/2003 | Katoh et al. |
| 6,666,988 | B2 | | 12/2003 | DelDuca et al. |
| 6,805,486 | B2 | | 10/2004 | Smith et al. |
| RE38,658 | E | | 11/2004 | Eichbauer |
| 6,818,296 | B1 | | 11/2004 | Garces Garces et al. |
| 6,821,587 | B2 | | 11/2004 | Forbes et al. |
| 6,841,392 | B2 | | 1/2005 | Bodenhamer |
| 6,845,878 | B2 | | 1/2005 | Hayes et al. |
| 6,913,807 | B2 | | 7/2005 | Kamei et al. |
| 6,921,581 | B2 | | 7/2005 | Van Gelder et al. |

| | | | | |
|---|---|---|---|---|
| 6,924,147 | B2 | 8/2005 | Kelly et al. | |
| 6,926,862 | B2 | 8/2005 | Fontenot et al. | |
| 6,979,455 | B2 * | 12/2005 | Ong et al. | 424/411 |
| 2001/0038805 | A1 | 11/2001 | Hamilton et al. | |
| 2002/0015542 | A1 | 2/2002 | Bradley | |
| 2002/0044891 | A1 | 4/2002 | Miller et al. | |
| 2003/0031387 | A1 | 2/2003 | Gipson et al. | |
| 2003/0031388 | A1 | 2/2003 | Gipson et al. | |
| 2003/0190273 | A1 | 10/2003 | Barenberg et al. | |
| 2003/0223657 | A1 | 12/2003 | Belias et al. | |
| 2004/0051191 | A1 | 3/2004 | Loh et al. | |
| 2004/0066985 | A1 | 4/2004 | Patel et al. | |
| 2004/0074902 | A1 | 4/2004 | Hayes et al. | |
| 2004/0124101 | A1 | 7/2004 | Satoh | |
| 2004/0134923 | A1 | 7/2004 | Aquino et al. | |
| 2004/0137031 | A1 | 7/2004 | Seitz et al. | |
| 2004/0137202 | A1 | 7/2004 | Hamilton et al. | |
| 2004/0141663 | A1 | 7/2004 | Gillis et al. | |
| 2004/0142495 | A1 | 7/2004 | Hartman et al. | |
| 2004/0170693 | A1 | 9/2004 | Pedersen et al. | |
| 2004/0197505 | A1 | 10/2004 | Jester et al. | |
| 2005/0000966 | A1 | 1/2005 | Nordland et al. | |
| 2005/0011012 | A1 | 1/2005 | Sun et al. | |
| 2005/0017005 | A1 | 1/2005 | Nomula | |
| 2005/0089548 | A1 | 4/2005 | Virgalitto et al. | |
| 2005/0106121 | A1 | 5/2005 | Hartman et al. | |
| 2005/0106192 | A1 | 5/2005 | Parekh et al. | |
| 2005/0106380 | A1 | 5/2005 | Gray et al. | |
| 2005/0112085 | A1 | 5/2005 | MacDonald et al. | |
| 2005/0129937 | A1 | 6/2005 | Patton et al. | |
| 2005/0153452 | A1 | 7/2005 | Williams et al. | |
| 2005/0163854 | A1 | 7/2005 | Hartman et al. | |
| 2005/0208089 | A1 | 9/2005 | Asrar et al. | |
| 2005/0215460 | A1 | 9/2005 | Borchers et al. | |
| 2005/0220374 | A1 | 10/2005 | Thomas et al. | |
| 2005/0220375 | A1 | 10/2005 | Thomas et al. | |
| 2005/0249952 | A1 | 11/2005 | Vasishtha et al. | |
| 2006/0013884 | A1 | 1/2006 | Ii et al. | |
| 2006/0110080 | A1 | 5/2006 | Thomas et al. | |

FOREIGN PATENT DOCUMENTS

| | | | |
|---|---|---|---|
| EP | 0471 036 | | 1/1996 |
| EP | 0699304 | | 3/1996 |
| GB | 238858 | | 11/2003 |
| JP | 04145007 | A * | 5/1992 |
| JP | 04207179 | | 7/1992 |
| JP | 05201822 | | 8/1993 |
| JP | 05286817 | | 11/1993 |
| JP | 06199614 | | 7/1994 |
| JP | 07 017575 | | 5/1995 |
| JP | 09 215485 | | 12/1997 |
| JP | 09110620 | | 6/1998 |
| JP | 10245309 | | 9/1998 |
| JP | 11106551 | | 4/1999 |
| JP | 2000 255522 | | 1/2001 |
| JP | 2001032172 | | 2/2001 |
| JP | 2001 062889 | | 3/2001 |
| JP | 2001087008 | | 4/2001 |
| JP | 2001 192563 | | 5/2001 |
| JP | 2001158702 | | 6/2001 |
| WO | WO 97/13416 | | 4/1997 |
| WO | WO 98/23159 | | 6/1998 |
| WO | WO 9949823 | | 10/1999 |
| WO | WO0013009 | | 3/2000 |
| WO | WO 01/46028 | | 6/2001 |
| WO | WO 02/042069 | | 5/2002 |
| WO | WO 03/044112 | | 5/2003 |
| WO | WO03072343 | | 9/2003 |
| WO | WO 2004/022220 | | 3/2004 |
| WO | WO 2004/022221 | | 3/2004 |
| WO | WO 2004043804 | | 3/2004 |
| WO | WO 2004/037023 | | 5/2004 |
| WO | WO 2005/009604 | | 2/2005 |
| WO | WO 2005/054367 | | 6/2005 |
| WO | WO 2005077773 | | 8/2005 |
| WO | WO2005078402 | | 8/2005 |

OTHER PUBLICATIONS

Osswald, T., "Polymer Processing Fundamentals", 1998, Table II.
PCT International Search Report for International Application No. PCT/US03/05967, Jun. 26, 2003.

* cited by examiner

PACKAGES WITH ACTIVE AGENTS

REFERENCE TO RELATED APPLICATIONS

The present application is a continuation-in-part of U.S. patent application Ser. No. 10/375,188 filed on Feb. 26, 2003 and now abandoned, which application claims the benefit under 35 U.S.C. § 119(e) of U.S. Patent Application No. 60/359,874 filed on Feb. 27, 2002.

The present application also claims the benefit under 35 U.S.C. § 119(e) of U.S. Patent Application Nos. 60/543,344 and 60/543,345, each filed on Feb. 10, 2004 and now pending.

Each of the foregoing applications is expressly incorporated by reference herein in its entirety.

FIELD OF THE INVENTION

The present invention relates to packages and structures and methods for releasing active agents in such packages. More specifically, the present invention relates to active agents, such as freshness-extension agents, odor management agents, and other functional agents, and structures and methods for releasing such active agents to extend the freshness of perishable products and manage or control the odor related to such products disposed within such packages.

BACKGROUND OF THE INVENTION

Reclosable packages, such as food containers with fitted or hinged lids, and bags with push to close or slider fasteners, are a great convenience to suppliers and consumers of pre-packaged perishables, especially for products such as luncheon meats and cheeses where, typically, only a portion of the product is used at any given time. Reclosable packages are also especially convenient for in-home use to store leftover perishable products. A problem with these reclosable packages, however, is that they do not contain any feature that serves to extend the time period that the perishable can be stored in the package and remain fresh. Thus, the contents of the package may spoil sooner and, if so, the contents will be no longer suitable for human consumption. The cost of perishable spoilage is a significant problem for both consumers and commercial users of reclosable packages.

One attempt to address the problem of perishable spoilage has involved using layered tamper resistant seals that are substantially impermeable to oxygen. In this type of system, as soon as the packaging is first opened, the seal is broken and does not further inhibit spoilage of the perishable. This type of system thus addresses only the issue of perishable spoilage before the package is initially opened, and does not serve the in-home user who is placing leftover perishable products into the storage bags.

A need therefore exists for a package with a feature that inhibits perishable spoilage.

SUMMARY OF THE INVENTION

Packages with active agents are disclosed herein.

Generally, each of the disclosed packages of the present invention has a pair of opposing body panels joined together along a pair of opposing sides and a bottom bridging the sides so as to define a mouth opposite the bottom, a reclosable fastener extending along the mouth, and an active agent. The reclosable fastener includes a pair of polymeric tracks, in which each of the tracks includes a mating element and a fin portion. The mating elements are releasably engageable to each other. Each of the fin portions extends generally downwardly from the respective mating element towards the bottom of the reclosable package.

In accordance with one aspect of the present invention, a reclosable package is provided with an active agent that is associated with at least one of the fin portions for communication with an interior of the package. The active agent is applied to the at least one of the fin portions by at least one of brushing, impregnating, laminating, spraying, coating, and stamping the active agent onto the at least one of the fin portions. Alternatively, the active agent is extruded with the at least one of the fin portions. For example, the active agent can be distributed in the form of microcapsules in the at least one of the fin portions. Alternatively, the active agent is included in an active agent layer that is attached to the at least one of the fin portions via at least one of an adhesive, a co-extrusion, a heat seal, and a weld (e.g., an ultrasonic weld). Alternatively, the active agent is included in at least one of a coating, a patch, a pouch, and a tape, applied to the at least one of the fin portions.

In accordance with another aspect of the present invention, the active agent is a freshness-extension agent that includes an isothiocyanate compound. The freshness-extension agent can further include an acid and/or a fragrant.

In accordance with another aspect of the present invention, a structure to selectively initiate release of the active agent is provided. Alternatively, the active agent is released by humidity.

In accordance with another aspect of the present invention, a one-time breakable element extending between the fin portions and disposed between the interior and the reclosable fastener is provided. The active agent can be disposed above and/or below the one-time breakable element.

In accordance with another aspect of the present invention, a barrier layer associated with the at least one of the body panels is provided to define a barrier environment for the interior.

In accordance with another aspect of the present invention, a barrier layer associated with at least one of the fin portions is provided. The barrier layer is located further from the interior than an active agent layer including the active agent.

In accordance with another aspect of the present invention, a diffusion layer associated with at least one of the fin portions is provided. The diffusion layer is adjacent to an active agent layer including the active agent. The diffusion layer is located closer to the interior than the active agent layer.

In accordance with another aspect of the present invention, a reclosable package is provided with a first opposing body panel having an inner surface and an outer surface, a second opposing body panel having an inner surface and an outer surface, and a reclosable polymeric seal. The first and second body panels are joined along a pair of opposing sides and a bottom bridging the sides so as to form an open mouth at one end. The joined body panels form an interior space. The reclosable polymeric seal extends along the one end of the respective inner surfaces of the first and second opposing body panels and includes first and second polymeric tracks. The first polymeric track includes a first mating element and a first fin portion, in which the first fin portion extends generally downwardly from the first mating element towards the bottom of the package. The second polymeric track includes a second mating element and a second fin portion, in which the second fin portion extends generally downwardly from the second mating element towards the bottom of the package. The first and second mating elements are releasably engageable to each other. The first fin portion includes at least a first layer having an active agent and a second layer being a barrier layer. The second fin portion includes at least a third layer having an active agent and a fourth layer being a barrier layer.

These and other features of the disclosed packages of the present invention can be more fully understood by referring to the following detailed description and accompanying drawings. The drawings are not drawn to scale, but show only relative dimensions.

DETAILED DESCRIPTION OF THE INVENTION

Figure 1A:
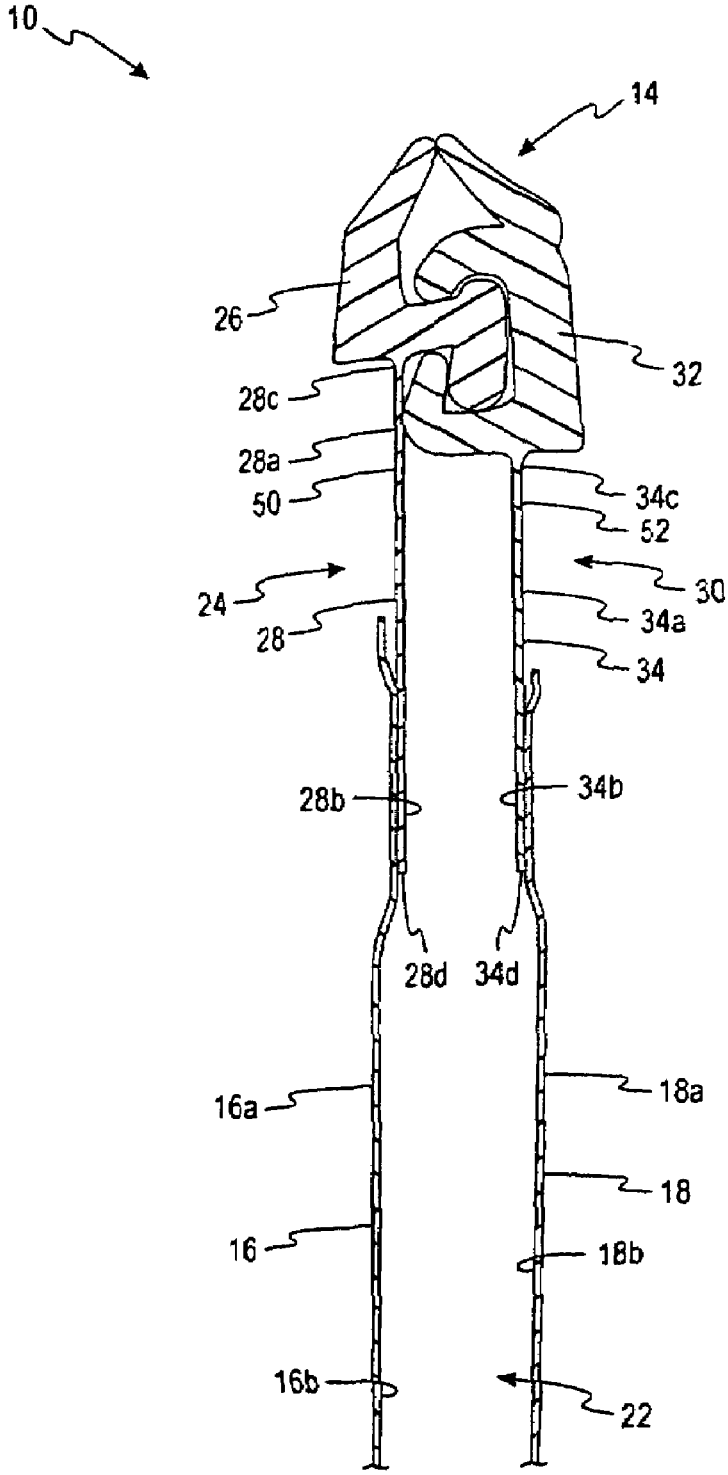
FIG. 1*a* is a sectional view of a mouth portion of a reclosable package or bag according to one embodiment of the present invention.

The present invention relates to packages, packaging materials, and other related structures with an active agent incorporated therein. As such, the invention has applications for various flexible and rigid containers and packages, such as reclosable plastic bags, waste bags and liners, rigid trash containers, air-tight containers, lunch boxes, and packaging wraps and foils commonly used for perishable packaging or perishable covering.

As used herein, the term "package" can be understood to include any kind of package or container, such as flexible plastic bags and rigid containers, as well as foils or wraps commonly used to package or store perishable items.

As used herein, the term "active agent" can be understood to include any agent, ingredient, or composition that provides an enhancing or beneficial effect within a package or container. An active agent can include a "freshness-extension" agent for extending the freshness or shelf life of food products or other perishables stored in a package, an "odor management" agent for masking, neutralizing and/or reducing odors from the package, or another functional agent.

Each of the active agents of the present invention can be used in combination with a package. More specifically, each freshness-extension agent of the present invention can be used to inhibit spoilage of food products or other perishables in the package, and each odor management agent of the present invention can be used to reduce, neutralize, and/or mask odors from the package. Each of the active agents of the present invention can be disposed in the environment of the package, e.g., disposed in the form of a coating, patch, pouch, or tape that is applied to a component of the package; extruded with a component of the package; sprayed, brushed, coated, laminated, or stamped onto a component of the package; impregnated into a component of the package; and/or distributed in the material of a component of the package, such as in the form of microcapsules.

For purposes of illustration and not limitation, the freshness-extension agents of the present invention can be disposed in the environment of a polymeric bag for storing perishable items. The polymeric bag can be intended for consumer storage of food products (e.g., leftover food products) or applications, such as "form, fill, and seal" food packaging operations. The polymeric bags can include non-reclosable and reclosable polymeric bags. Reclosable polymeric bags are typically made to be reclosable via reclosable elements or fasteners, such as resealable adhesive or cohesive seals, welds (e.g., ultrasonic welds), mated tracks, and mated dimples. The mated tracks can be opened and closed by applying finger pressure or by using an auxiliary device, such as a slider. Some examples of reclosable polymeric bags include the bags disclosed in U.S. Pat. Nos. 5,067,208 and 6,147,588 and U.S. Patent Application Publication No. 2004/0066985, the contents of which documents are expressly incorporated by reference herein in their entireties.

Further for purposes of illustration and not limitation, the freshness-extension agents of the present invention can also be disposed in the environment of a rigid package for storing perishables, such as bakery containers, deli containers, fruit containers, lunch boxes, and roaster containers. Some examples of containers include containers disclosed in U.S. Pat. Nos. 6,042,586, 6,257,401, 6,349,857, 6,644,494, 6,845,878 and U.S. Patent Application Publication Nos. 2004/0074902 and 2005/0000966, the contents of which documents are expressly incorporated by reference herein in their entireties.

Additionally for purposes of illustration and not limitation, the odor management agents of the present invention can be used in the environment of bags and liners for collecting garbage or waste and other containers for collecting items with undesirable odors, such as laundry and diapers. Such waste bags can include a tie feature that assists in closing the bag or liner securely, forming a handle for carrying the bag or liner to be disposed, and/or facilitating the opening of the bag or the liner. Some examples of waste bags include the bags disclosed in U.S. Patent Application Publication No. 2003/0223657, the contents of which document are expressly incorporated by reference herein in its entirety.

Illustrative embodiments will now be described to provide an overall understanding of the disclosed packages and related structures and active agents. For purposes of illustration and not limitation, the packages of the present invention are described in the context of reclosable polymeric bags. One or more examples of the illustrative embodiments are shown in the drawings. Those of ordinary skill in the art will understand that each disclosed bag having an active agent can be adapted and modified to provide alternative embodiments of bags, containers, and other packages with active agents for other applications, and that other additions and modifications can be made to the disclosed packages and active agents without departing from the scope of the present disclosure. For example, features of the illustrative embodiments can be combined, separated, interchanged, and/or rearranged to generate other embodiments. Such modifications and variations are intended to be included within the scope of the present disclosure.

Figure 1B:
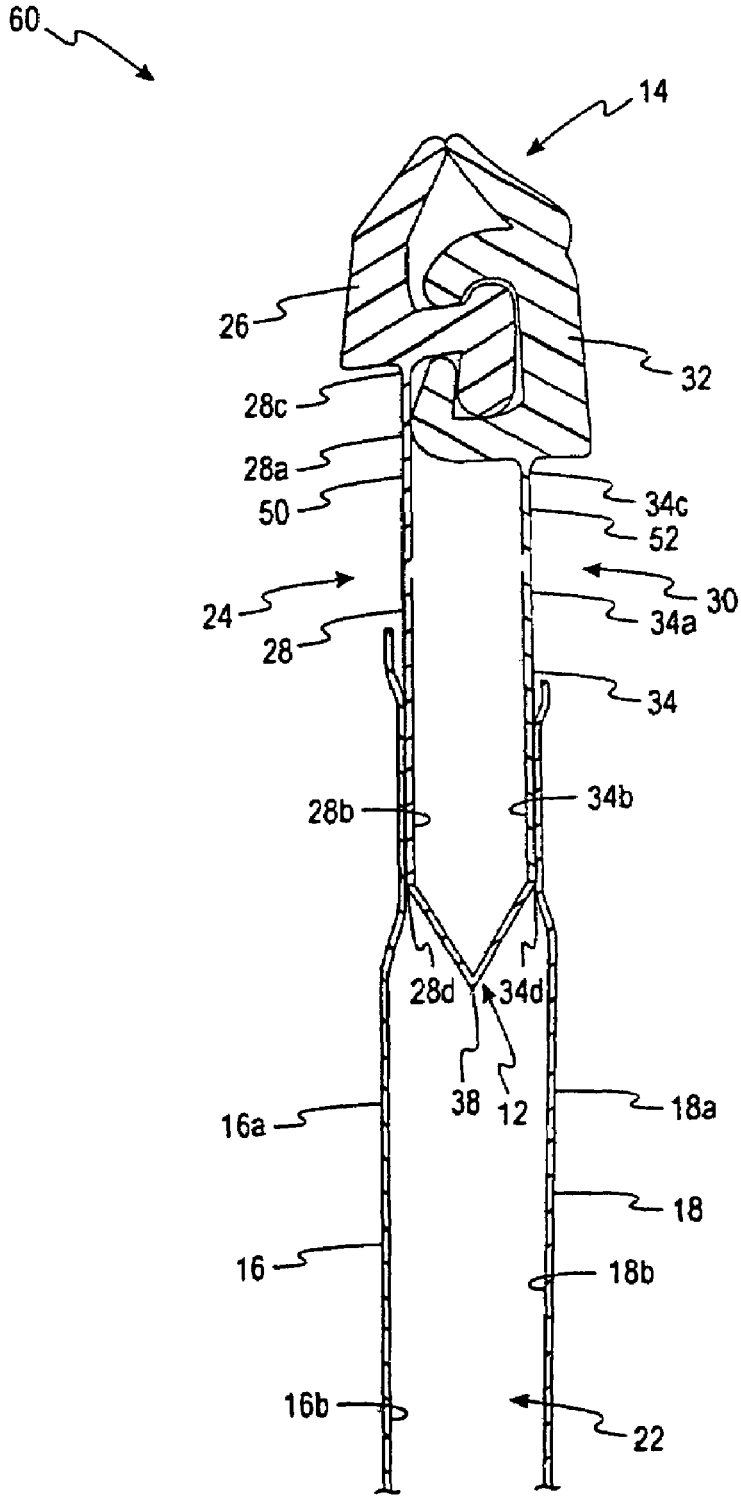
FIG. 1*b* is a sectional view of a mouth portion of a reclosable package or bag according to another embodiment of the present invention.
Figure 1C:
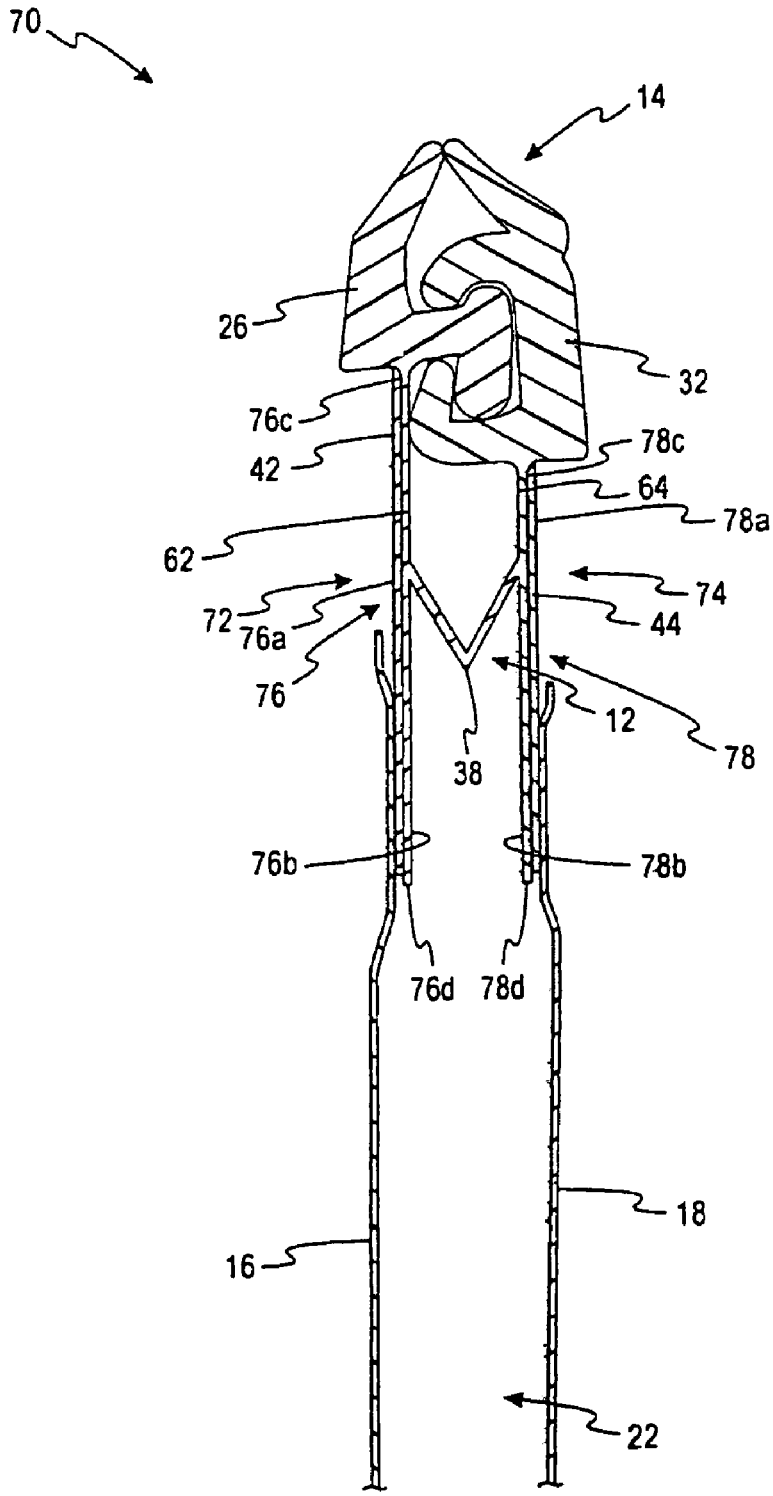
FIG. 1*c* is a sectional view of a mouth portion of a reclosable package or bag according to a further embodiment of the present invention.
Figure 1D:
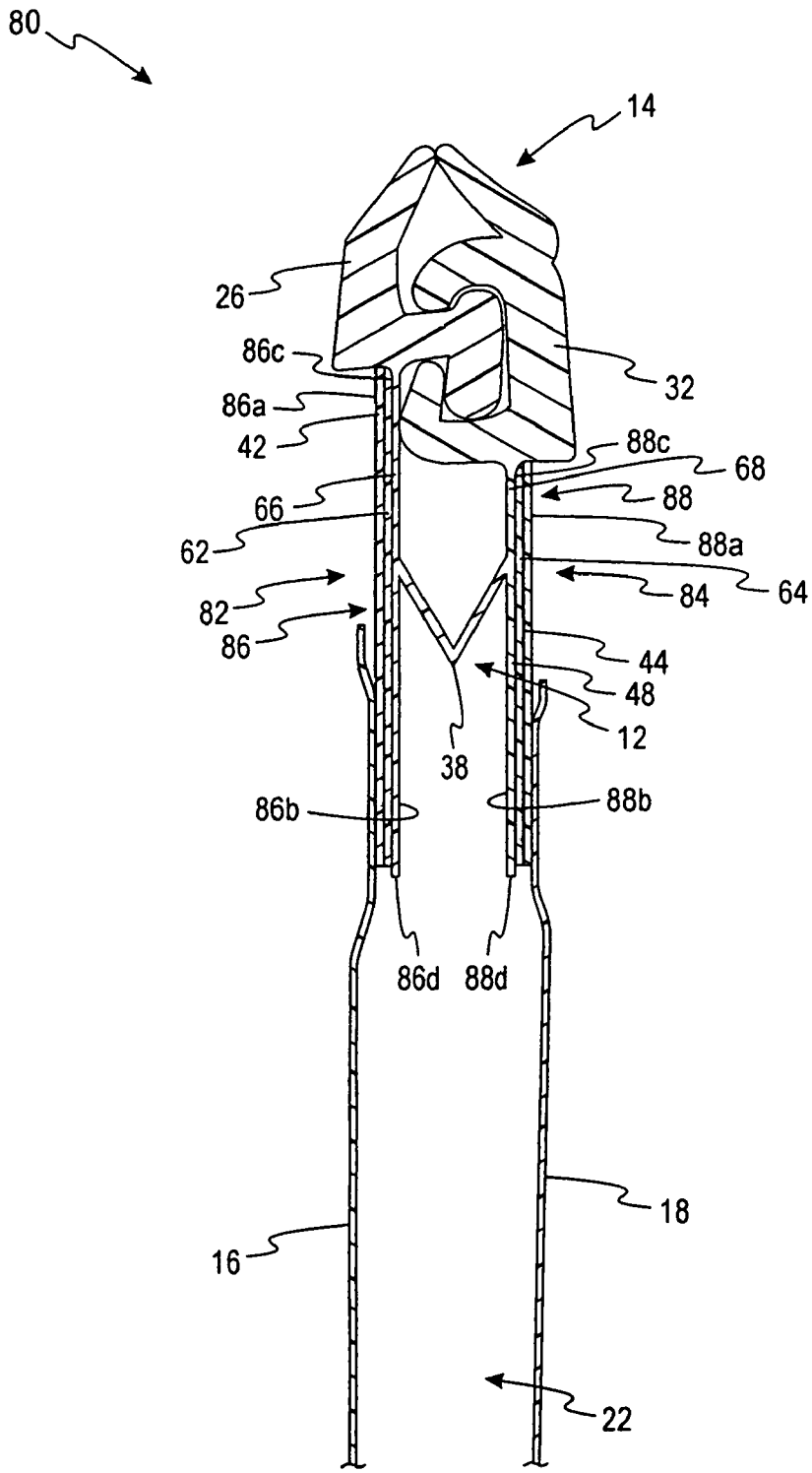
FIG. 1*d* is a sectional view of a mouth portion of a reclosable package or bag according to yet another embodiment of the present invention.
Figure 2:
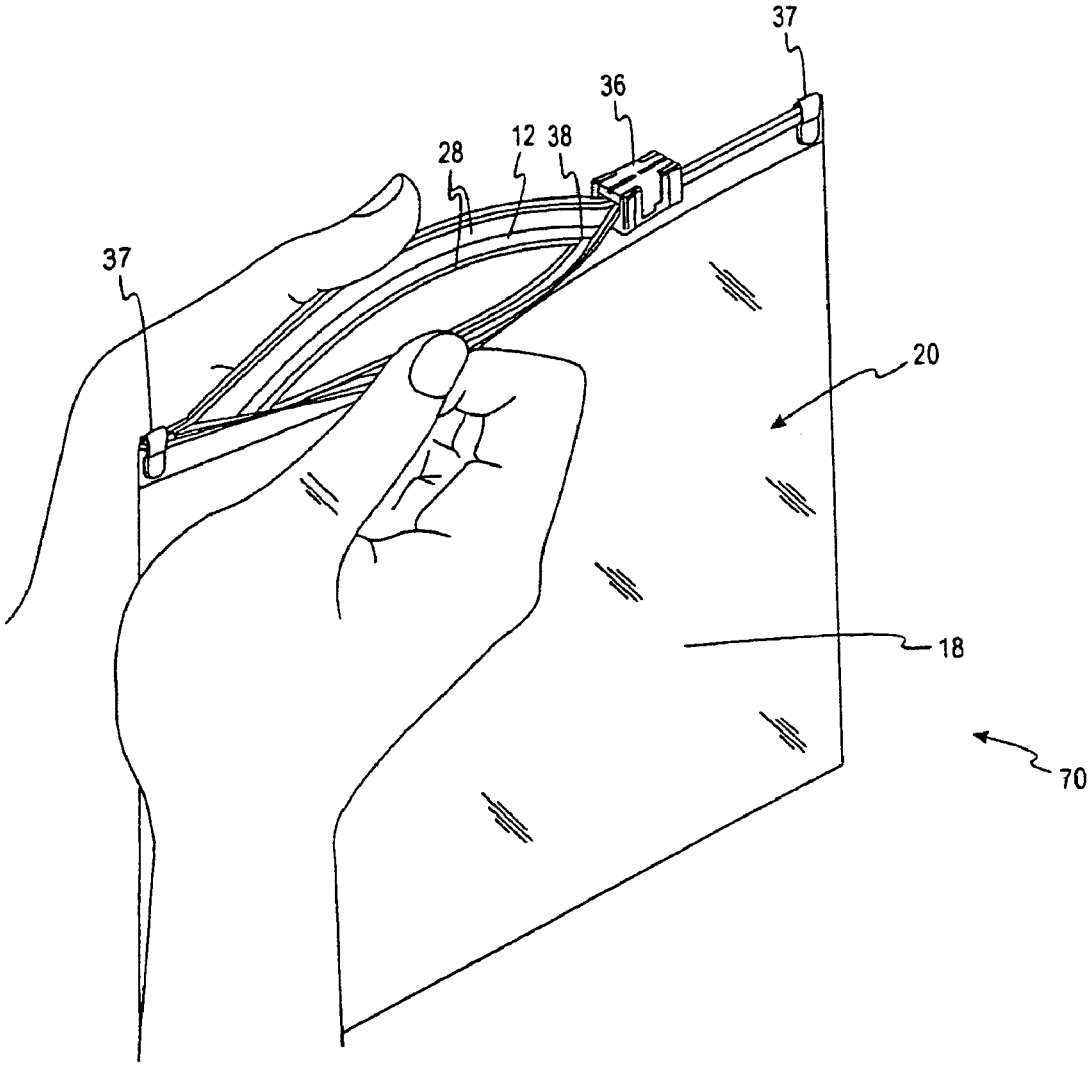
FIG. 2 is a perspective view of the reclosable package incorporating a mouth portion of FIG. 1*b* in which a reclosable fastener or zipper has a slider mechanism being opened and a one-time breakable element being partially opened.

Turning now to the drawings, FIG. 1*a* depicts a mouth portion defined by a reclosable package or bag 10 with a reclosable closure arrangement such as fastener or zipper 14. The fastener or zipper 14 can be opened and closed by applying finger pressure or by using an auxiliary squeezing device, such as a slider. FIGS. 1*b*-1*d* depict other mouth portions defined by reclosable packages or bags with a fastener or zipper. FIG. 2 shows a reclosable package 70 with the mouth portion depicted in FIG. 1*b* in a partially open position.

Referring back to FIG. 1*a*, the mouth portion of the reclosable package 10 includes a pair of first and second opposing body or wall panels 16, 18 that make up a package body 20 (FIG. 2) and define an interior space 22. Connected to the first body panel 16 is a first track 24 having a first profile 26 and a first fin portion 28 extending generally downward from the first profile 26. The first body panel 16 has an outer surface 16*a* and an inner surface 16*b*. The first fin portion 28 has an outer surface 28*a* and an inner surface 28*b*. Connected to the second body panel 18 is a second track 30 having a second profile 32 and a second fin portion 34 extending generally downward from the second profile 32. The second body panel 18 has an outer surface 18*a* and an inner surface 18*b*. The second fin portion 34 has an outer surface 34*a* and an inner surface 34*b*. The inner surface 16*b* is attached to the outer surface 28*a*. The inner surface 18*b* is attached to the outer surface 34*a*. The first and second profiles 26, 32 are releasably engageable with each other to provide a reclosable seal to the package 10. The thicknesses of the first and second fin portions 28, 34 generally vary from about 2 to about 10 mils. More specifically, the thicknesses vary from about 4 to about 7 mils.

The reclosable packages of FIGS. 1*a*-1*d* can further include an optional auxiliary slider mechanism 36 (FIG. 2) slidably mounted to the fastener 14 for movement between a closed position and an open position. Referring to FIGS. 1*a*-1*d* and 2, the first and second profiles 26, 32 are engaged to each other while the slider mechanism 36 is in the closed position, and movement of the slider mechanism 36 from the closed position to the open position disengages the profiles 26, 32 from each other.

The package 70 of FIG. 2 also includes end terminations 37. End terminations can have various purposes such as (a) preventing or inhibiting the slider mechanism 36 from going past the ends of the fastener 14, (b) interacting with the slider 36 to give a tactile indication of being closed, (c) assisting in inhibiting or preventing leakage from the package 70, and (d) holding the first and second profiles 26, 32 together and providing additional strength in resisting stresses applied to the profiles 26, 32 during normal use of the package 10. Further details concerning the construction and operation of the slider mechanism 36 and the end terminations 37 can be obtained from U.S. Pat. No. 5,067,208 to Herrington, Jr. et al., which is incorporated herein by reference in its entirety.

It is contemplated that other end terminations can be used instead of the above described end terminations 37. For example, an end weld can be formed by heated bars pressed against the end of the fastener, ultrasonic welding, or other ways known in the art.

As illustrated in FIGS. 1*a*-1*d* and 2, the reclosable packages are opened by having a consumer grip the slider mechanism 36 and move it such that the first and second profiles 26, 32 of the respective first and second tracks are detached from each other. Next, the consumer tears open the optional breakable element 12 (if present) along the preferential area of weakness 38. Alternatively, the consumer can open the breakable element 12 by cutting therethrough. The package can be resealed utilizing the fastener 14 and slider mechanism 36. Specifically, the consumer grips the slider mechanism 36 and moves it from the open position to the closed position so as to engage the complementary first and second profiles 26, 32.

A one-time breakable element 12 not only provides a consumer with the assurance that the newly purchased package has not been opened before, but also provides a good initial seal that preserves the freshness of the food products, perishables, or other contents of the package prior to its initial opening and can inhibit or prevent the active agent from being activated by an activation-triggering condition, such as moisture. Since the reclosable closure arrangements of FIGS. 1*b*-1*d* are located above the one-time breakable element, (i.e., the reclosable closure arrangement is further from the interior space), the operation of the reclosable closure arrangement is not hampered by the presence of the one-time breakable element.

The first fin portion 28 and the second fin portion 34 have active agents 50 and 52, respectively, associated therewith. The active agents 50, 52 can be the same or can be different. Each active agent 50, 52 can include a substance known to provide a desired function or effect on a package or contents thereof. In some embodiments, the active agents include freshness-extension agents, which function to extend the life or freshness of food products or other perishables disposed in the package. In other embodiments, the active agent includes an odor management agent, which functions to mask, neutralize, and/or reduce an undesirable odor or to produce an aromatic odor in the package.

The agent 50 is incorporated within or on the fin portion 28. In some embodiments, the agent 50 is extruded with, or impregnated within, the first fin portion 28. For example, the agent 50 can be distributed in the form of microcapsules in the material of the first fin portion 28. In a preferred embodiment, the active agent is microencapsulated prior to being integrated into the package structure. Microencapsulation encloses the active agent within a polymeric material that can withstand heat during package processing and manufacturing, but which degrades, dissolves, or otherwise breaks open and releases the active agent upon contact with pre-determined environmental factors such as moisture. The active agent can be encapsulated into microcapsules, and the microcapsules can be interspersed with the molten material of the fastener and extruded into the fastener 14 during bulk production.

The first fin portion 28 can be otherwise impregnated with the active agent 50. It is also contemplated that the active agent 50 can be sprayed, brushed, coated, laminated, stamped, or otherwise applied onto the first fin portion 28. For example, the active agent can be disposed in a coating, patch, pouch, or tape that is applied (e.g., via a pressure-sensitive adhesive) to the first fin portion 28 after production of fastener 14. The selection of a coating, patch, pouch, or tape is often dependent on the type of active agent being used. For example, an active agent in a powder form (e.g., minerals containing chemistry) can be placed in an air-permeable pouch rather than a patch because it is often difficult to embed powders in a patch. Alternatively, an active agent in a powder form can be dusted onto a component of the package, e.g., a fin or a body panel. Non-limiting examples of powdery active agents that can be incorporated into the agent-containing structure include perlite, calcium carbonate, kaolin, and ASEPTROL® antimicrobial manufactured by Engelhard.

If a tape or patch is used to support the agent-containing structure, the tape or patch can include an adhesive, a patch-like component, and/or a release system such as a slip additive which assists in inhibiting or preventing the agent structure from sticking to the adhesive. For example, the release system can be located on a surface of the tape or patch that is located distally from the surface that contacts the body panel to which the tape or patch is to be attached, so that sticking is inhibited or prevented when the package is wound into a roll. Materials such as siloxane and glycerol monostearate can be among the components of such a release system.

An agent structure can vary in size and is dependent on factors such as the desired amount of the agent, the particular agent being used, the number of agent structures being used in the package, and the size of the package. According to another embodiment, the package may include two or more active agent structures.

The agent structures of the present invention, such as a patch, tape, or pouch, can be attached to a package such as a reclosable bag by a pressure-sensitive self-adhesive. The pressure-sensitive self-adhesive can be any suitable adhesive that attaches the agent structure to the reclosable package. Non-limiting examples of pressure-sensitive adhesives that can be used include acrylic or rubber-based adhesives.

The agent structure being a tape or pouch can be roll fed onto a layer(s) of the reclosable package. The roll-fed structure being a tape or pouch can also initially include a release liner that assists in preventing or inhibiting the agent from sticking to itself before delivery to the reclosable package. The release liner, if used, is separated from the roll-fed tape or pouch before the tape or pouch is attached to the reclosable package or bag. Examples of release liners include silicon-coated paper. Release liners, however, may be undesirable because of the additional cost associated therewith. It is contemplated that the agent structure can be roll fed without the use of a release liner before being attached to the reclosable package or bag.

Alternatively, the agent being a patch or pouch can be magazine fed during attachment to the reclosable package. The patch is preferably magazine fed, while the pouch can be magazine or roll fed. The tape is preferably roll fed during attachment to the reclosable package. For example, the tape can be unwound, cut to length and attached to the reclosable package.

According to another embodiment, the agent structure patch, tape, or pouch can be heat sealed directly to the reclosable package or bag. The structure can be roll fed or magazine fed before being heat sealed to the reclosable package. In a heat-sealing embodiment, a release liner would not likely be used because the agent structure without any adhesive should not stick to itself and the release liner adds an unnecessary cost. The agent structure can be attached to the reclosable package at several locations. The agent structure can be attached to the body panels during the formation of the heat seals. For example, the agent structure may be located between a side seal formed between the first and second body panels. It is contemplated that other attaching methods can be used.

It is contemplated that additional layers can be added to the coating, patch, pouch, or tape. For example, a barrier layer can be added to assist in keeping the agent in communication with the interior of the reclosable package and, thus, assist in preventing or inhibiting the freshness-extension agent from permeating through the body panel.

It is also contemplated that information can be printed on the agent structure such as on the barrier layer. It is contemplated that the printing can occur on different locations of the structure. For enhanced visibility and readability of the printing, it may be desirable to print on the surface of the agent structure that is closest to the body panel when the structure is located in the interior of the reclosable package.

The agent structure being a coating, patch, pouch, tape in one embodiment is located in the interior of the reclosable package. Alternatively, the agent structure being a coating, patch, pouch, tape can be located on an exterior surface of the package or within layers of the package such that the agent is able to permeate into or communicate with the interior of the package. For example, the agent structure being a coating, patch, pouch, or tape can be located on an exterior surface of a reclosable package in which a portion of the body panel is removed such that the agent contained in the structure can permeate into the interior of the reclosable package. It is contemplated that a layer of a reclosable package can be permeable to the agent such that the agent is in communication with the interior of the reclosable package.

Similarly, the active agent 52 can be incorporated or impregnated into or extruded with the second fin portion 34. It is also contemplated that the active agent 52 can be sprayed, brushed, coated, laminated, stamped, or otherwise applied onto the second fin portion 34.

In some embodiments, the active agents 50, 52 include one or more freshness-extension agents. Each of the freshness-extension agents can be, for example, a natural oil, an anti-microbial, an acid, or another substance that can extend the freshness or shelf life of food products or perishables. For example, some non-limiting examples of freshness-extension ingredients include isothiocyanate such as allyl isothiocyanate (AIT) from natural sources, d-limonene, eugenol, allicin, isothymol, thymol, chlorine dioxide, hydrogen peroxide, sodium percarbonate, ascorbic acid, citric acid, cinnamic aldehyde, mustard, cinnamon, peppermint, spearmint, triclosan, Chinese chive (*Allium* tuberosum), cinnamon (*Cinnamomum cassia*), corni fructus (*Cornus officinalis*), allyl cyanide, 1-cyano-2,3-epithiopropane, allyl thiocyanate, *Lactobacillus reuteri*, methyl isothiocyanate, cinnamon bark oil, lemon grass oil, thyme oil, methyl jasmonate, tea tree oil, ethyl alcohol, Salicylaldehyde, carvacrol, cymene, essential oil extracts of various onions, essential oil extract of garlic, berry phenolic extracts from cranberry, cloudberry, raspberry, strawberry, and bilberry, ellagitannins from cranberry, cloudberry, raspberry, strawberry, and bilberry, essential oils from nutmeg, mint, clove, oregano, cinnamon, sassafras, sage, thyme and rosemary, vanillin, vanillyl alcohol, vanillic acid, diacetyl, natural honey, fluorine dioxide, carbon dioxide, modified atmospheres and combinations thereof. The modified atmosphere can include nitrogen, oxygen, sulfur dioxide, carbon monoxide, carbon dioxide and combination thereof.

AIT, which can be naturally obtained from plants or foods such as mustard and wasabi, is particularly advantageous as a freshness-extension agent because of its anti-microbial properties. The AIT is produced from plants such as mustard, which contains glucosinolate and myrosinase enzyme. Myrosinase and glucosinolate react with each other to produce AIT and, because the reaction involves hydrolysis, humidity activates AIT production. AIT has been shown to exhibit anti-bacterial and anti-microbial properties. Because AIT is released in a gaseous form, AIT can permeate an interior of a package so as to inhibit bacterial growth therein and thereby extend food product or perishable freshness. Hence, AIT-producing products, including wasabi, horseradish and mustard in various forms, such as extract, powder, oil, or ground seed, can be used as the freshness-extension agent in embodiments of the present invention.

In some embodiments, an AIT-containing freshness-extension agent can also be used in combination with another functional agent. For example, in one such embodiment, AIT is combined with an acid, which greatly enhances the production of AIT from mustard and, thus, the anti-microbial effect of mustard. Thus, if ground mustard seed is used as the freshness-extension agent, it can be combined, in a desired ratio, with an anhydrous acid such as anhydrous citric acid for increased AIT production and enhanced freshness-extension function.

The freshness-extension agent can also provide other functions, and can therefore be used for such other purposes. In some embodiments, the freshness-extension agent can include a freshness component for extending food freshness and an odor component for masking, reducing, and/or neutralizing only a pungent odor of the freshness component, but not other odors of the contents stored in a package. Preferably, the odor component does not mask the odors of the contents stored in the package, such as food odors or food spoilage odors, so that decay or spoilage of the contents can be detected by scent. For example, a freshness-extension agent including an AIT freshness component can also include a fragrant component, such as vanilla, cinnamon, or citrus oil, which can mask the pungent odor of AIT, but not mask or otherwise affect the odor of the stored contents. Preferably, the freshness-extension agent does not impart its own organoleptic properties to the stored contents, and thus permits a user to readily detect decay or spoilage of stored contents by smell.

Alternatively, in some embodiments, the active agents 50, 52 include one or more odor management agents. Advantageously, the odor management agent can be incorporated into packages configured for collecting garbage or waste to mask, neutralize, and/or reduce undesirable odors. Alternatively, the odor management agent can be used to provide or create an odor to a package. An odor management agent can thus be incorporated into thermoplastic bags or liners and other containers, such as garbage or waste bags, diaper containers, laundry bags, storage bags, and disposable medical bags or containers.

Non-limiting examples of odor management agents include AIT, d-limonene, mustard, natural oils, chlorine dioxide, hydrogen-sulfide, methyl mercaptan, ammonia, citronella, pine, flowery, and substituted esters such as METAZENE®.

A preferred embodiment of an odor management agent includes AIT, which agent can be provided by incorporating, for example, mustard in the active agent. Mustard, whether in the form of ground mustard seed, powder, oil, or paste, can be provided alone or in combination with an acid (such as citric acid) to catalyze the production of AIT from mustard and enhance the anti-microbial and odor management properties of the mustard. Because of its effectiveness in extending perishable freshness as previously described herein, AIT can provide multiple functions when incorporated into a perishable package, e.g., AIT can perform both freshness-extension and odor-management functions.

In some embodiments, the odor management agent can include an additional ingredient for providing a pleasant or desired odor or scent to a user. For example, a natural oil such as lemon grass oil can be used to manage odors emanating from a package, to mask the odor of the primary odor management agent itself, or to make the odor of the odor management more pleasant to a user. It has been shown that a composition comprising ground mustard seed and anhydrous citric acid mixed with about 5% by weight of lemon grass oil is particularly effective at managing unpleasant odors.

If an active agent 50, 52 includes an aromatic or perfumery ingredient for providing a desired scent to a package, an additional material for enhancing scent concentration in the interior of the package can be included. For example, the active agent 50 can include perlite to increase the scent concentration. Perlite is desirable for use because of its ability to retain scent, its stability, and its surface area. Non-limiting examples of other materials for enhancing scent include microspheres, talc, silicon, silicate such as aluminum silicate, vermiculite, diatomaceous earth, or combinations thereof.

Further in accordance with the invention, the first and second fin portions containing at least one active agent include activation systems that are triggered when the reclosable package is opened or filled with content. The activation systems can be mechanical in nature, such as a perforation or a peel-apart system that once separated initiates the release of the active agent. Another activation method can be based on the humidity or moisture level present in the package (which correlates to water activity of the contents). For example, a high amount of humidity can initiate a chemical reaction that subsequently releases a volatile chemical such as carbon dioxide or chlorine dioxide. In such an example, a greater amount of active agent is added when the humidity is higher in the reclosable package. Examples of reactions that are activated by a high humidity level are salt and acid reactions, such as sodium bicarbonate and citric acid, or sodium hypochloride and citric acid reactions. The release of AIT is also aided by humidity as previously explained. In such examples, a greater amount of active agent is released into the package atmosphere when the humidity increases.

During a method of operation of a reclosable package with a humidity-activated freshness extension agent, for example, perishables are placed in the interior of the package, and the humidity or moisture level in the perishables activates the freshness-extension agent. Additionally, if the agent is disposed proximate the mouth of a bag-like package or proximate the rim of a container-like package, selective activation or release can be accomplished. For example, the humidity or moisture level of the perishables can activate the agent as the perishables travel in the vicinity of the agent (e.g., through the mouth or past the rim of the package during the initial placement of the perishable products into the interior), while the perishable products remain disposed in the interior, and upon entry of air into the interior (e.g., during an opening of the package). Disposing the agent proximate the mouth or rim of a package can also be advantageous when maximum display of the contents is desired in a transparent package.

A humidity activation method can further be controlled by providing a barrier layer material. For example, it is preferable that the body panels provide a barrier layer or be formed of a barrier material so as to create an enclosed environment to prevent or inhibit the introduction of humidity and the release of active agent when the package is closed. Also for example, the fin portions can provide a barrier layer or be formed of a barrier material. As used herein, the terms "barrier layer" and "barrier material" include layers or materials that inhibit or otherwise control the release of an active agent into a package atmosphere, rather than layers or materials that completely block or prevent such release.

An example of such a material is polyethylene glycol (PEG) incorporated into low density polyethylene (LDPE). Other materials providing a barrier to transfer of water, water vapor, oxygen, nitrogen, carbon dioxide, ethylene, volatile or non-volatile active agents include but are not limited to polymers, copolymers, blends, extrusions, co-extrusions, coatings, metalization or laminations of: low density polyethylene (LDPE), linear low density polyethylene (LLDPE), linear medium-density polyethylene (LMDPE), high density polyethylene (HDPE), very low density polyethylene (VLDPE), metallocene (mPE), polypropylene (PP), oriented polypropylene (OPP), acrylonitrile butadiene styrene (ABS), acrylonitrile-styrene-acrylate (ASA), acrylonitrile-EPDM-styrene (AES), ASA/AES copolymers, polyamide 6, polyamide 66 and their copolyamides, poly vinyl chloride (PVC), acrylic, polybutylene terephthalate (PBT), thermoplastic polyester (TPE), ethylene/ethyl acrylate (EEA), ethylene/vinyl acetate (EVA), polystyrene (PS), high impact polystyrene (HIPS), modified polystyrene, ethylene-vinyl alcohol (EVAL or EVOH), polyvinylidene chloride (PVDC), liquid crystal polymer (LCP), polyamides, polyacrylic acid (PAA), polylactic acid (PLA), polyethylene terephthalate (PET), polyethylene terephthalate glycol (PETG), saran, ceramic filled polymers, nanocomposite polymers, polychlorotrifluoroethylene (PCTFE), polymethyl methacrylate (PMMA), acrylonitrile-methyl acrylate (AC-MA), polyphenylene ether (PPE), polyphenylene oxide (PPO), thermoplastic elastomer, cellophane, nylon, polycarbonate (PC), modified polyolefins with barrier properties, cyclic olefin copolymeres, polyacrylonitriles, acrylonitrile copolymers, polyacetals, modified polyesters, acrylic derivatives, and inorganic barrier coatings. It is also contemplated that other barrier materials such as foils and metallized polymers such as metallized oriented polypropylenes (OPP) can be used. The barrier layer is substantially impermeable to at least water vapor and active agents, and, in some embodiments, also to oxygen, nitrogen, carbon dioxide, or combinations thereof. The barrier layer thus inhibits or prevents water vapor (and, in some embodiments, oxygen, nitrogen, and carbon dioxide) from entering the interior of the package, while inhibiting or preventing the active agent from escaping the interior of the package.

An example of a cyclic olefin copolymer that can be used in forming the barrier layer is TOPAS® 8007. Useful cyclic olefin copolymers are believed to be available from several companies. For example, Ticona, a business of Celanese AG, in Summit N.J. has cyclic olefin copolymers available. Other companies that are believed to have cyclic olefin copolymers available include Nippon Zeon (Japan), Mitsui Chemical (Japan) and JSR (Japan), formerly know as Japan Synthetic Rubber. Ticona, a business of Celanese AG, has commercially available cyclic olefin copolymers (COCs) under the designation TOPAS®. These cyclic olefin copolymers are believed to be prepared with feedstocks of norbornene and ethylene and the use of a metallocene catalyst. There are believed to be at least four grades of TOPAS® resins available (TOPAS® 8007, TOPAS® 6013, TOPAS® 6015 and TOPAS® 6017). The four grades of TOPAS® resins available have glass transition temperatures, $T_g$, of 80, 140, 160 and 180° C., respectively. The corresponding norbornene levels of the four grades of TOPAS® resins are 35, 48, 55 and 59 mole %.

It is preferred that water soluble materials, such as PVOH, do not comprise the barrier layers 42, 44 alone because those materials can dissolve in a moisture environment, lose strength, and/or barrier characteristics. It is contemplated that additional layers such as tie or adhesive layers can also be used in the present invention.

The first fin portion 28 containing the active agent 50 can be made of polymeric materials including thermoplastic materials. Alternatively, if formed as part of the package, a polymeric matrix layer can be provided for impregnating or supporting a microencapsulated active agent into a component of the package, e.g., a fin portion. The matrix layer of the agent structure 50 can be made of polyolefinic materials such as polyethylenes, polypropylenes, polystyrenes, and combinations thereof. Non-limiting examples of the matrix layer materials include polymers, copolymers or blends of: low density polyethylene (LDPE), linear low density polyethylene (LLDPE), linear medium-density polyethylene (LMDPE), high density polyethylene (HDPE), very low density polyethylene (VLDPE), metallocene (mPE), polypropylene (PP), polyamide 6 polyamide 66 and their copolyamide, poly vinyl chloride (PVC), acrylic, thermoplastic polyester (TPE), ethylene/vinyl acetate (EVA), polystyrene (PS), high impact polystyrene (HIPS), modified polystyrene, liquid crystal polymer (LCP), polyamides, polyacrylic acid (PAA), polylactic acid (PLA), polyethylene terephthalate glycol (PETG), polymethyl methacrylate (PMMA), polyphenylene ether (PPE), thermoplastic elastomer, and cellulose and filled plastics. These materials generally provide a good barrier to water vapor, but allow permeation of oxygen and active agents. It may be desirable to have a patch, tape, or pouch that comprises polyethylene because of its recyclability. Another example of a material that can be used to form a patch, tape, or pouch structures is ethyl methyl acrylate (EMA). A surface of the patch, tape, or pouch can be formed of a porous nonwoven material (e.g., gauze) that allows the active agent such as freshness extension or odor management agent to be released. For odor management, one of the layers of the odor management structure can further include a fragrance (e.g., a liquid fragrance), a scent-enhancing mineral, and/or a polymeric resin (e.g., LLDPE).

Referring still to FIG. 1*a*, the first fin portion 28 has a length from a first fin top portion 28*c* to a first fin bottom portion 28*d*. It is contemplated that the length of the first fin portion 28 can vary by increasing the distance between the first fin top portion 28*c* and the first fin bottom portion 28*d*. A longer first fin portion 28 can contain additional active agent, and enable the food products or other perishables placed in the interior space 22 to be stored for a longer time period. Similarly, the second fin portion 34 has a length from a second fin top portion 34*c* to a second fin bottom portion 34*d*. Again, it is contemplated that the distance from the second fin top portion 34*c* to the second fin bottom portion 34*d* can vary depending on the amount of active agent that is needed in a given reclosable package 10.

As will be understood by those of ordinary skill in the art, the amount of agent to be used in combination with a package will depend on the environment in which the agent is in use, e.g., the loss and release rates of the agent. The release rate refers to the rate at which the agent is released into the interior of the package, and the loss rate refers to the rate at which the released agent escapes from the interior of the package. Preferably, the agents of the present invention are disposed in amounts such that the release rate of the agent is greater than the loss rate of the agent during a pre-determined "shelf life" or duration of use, so that the presence of agent in the interior of a package is replenished faster than it is lost, thus ensuring effective performance of the agent. The loss rate of the agent depends upon a variety of factors related to package design, construction, and use.

The reclosable package 10 can further include an optional breakable element. Referring to FIGS. 1*b*-1*d*, an optional breakable element 12 that initially extends from the first fin portion 28 to the second fin portion 34 can be used in the packages 60, 70, and 80, respectively. The breakable element 12 of FIGS. 1*b*-1*d* is depicted with an optional one-time breakable preferential area of weakness or preferential tear area 38 to form a one-time breakable tamper evident feature. The preferential area of weakness 38 can be a score line, a series of perforations, or a highly oriented region. Additionally, the one-time breakable preferential area of weakness 38 can be made in a manner to separate by cutting therethrough. The preferential area of weakness 38 inhibits tampering with the reclosable package prior to being opened. As shown in FIGS. 1*b*-1*d*, the location of the breakable element 12 can vary with respect to the ends of the first and second fin portions. It is not necessary that the breakable element 12 have the one-time breakable preferential area of weakness. For example, in some embodiments, the breakable element 12 includes a resealable adhesive or cohesive seal.

Figure 3A:
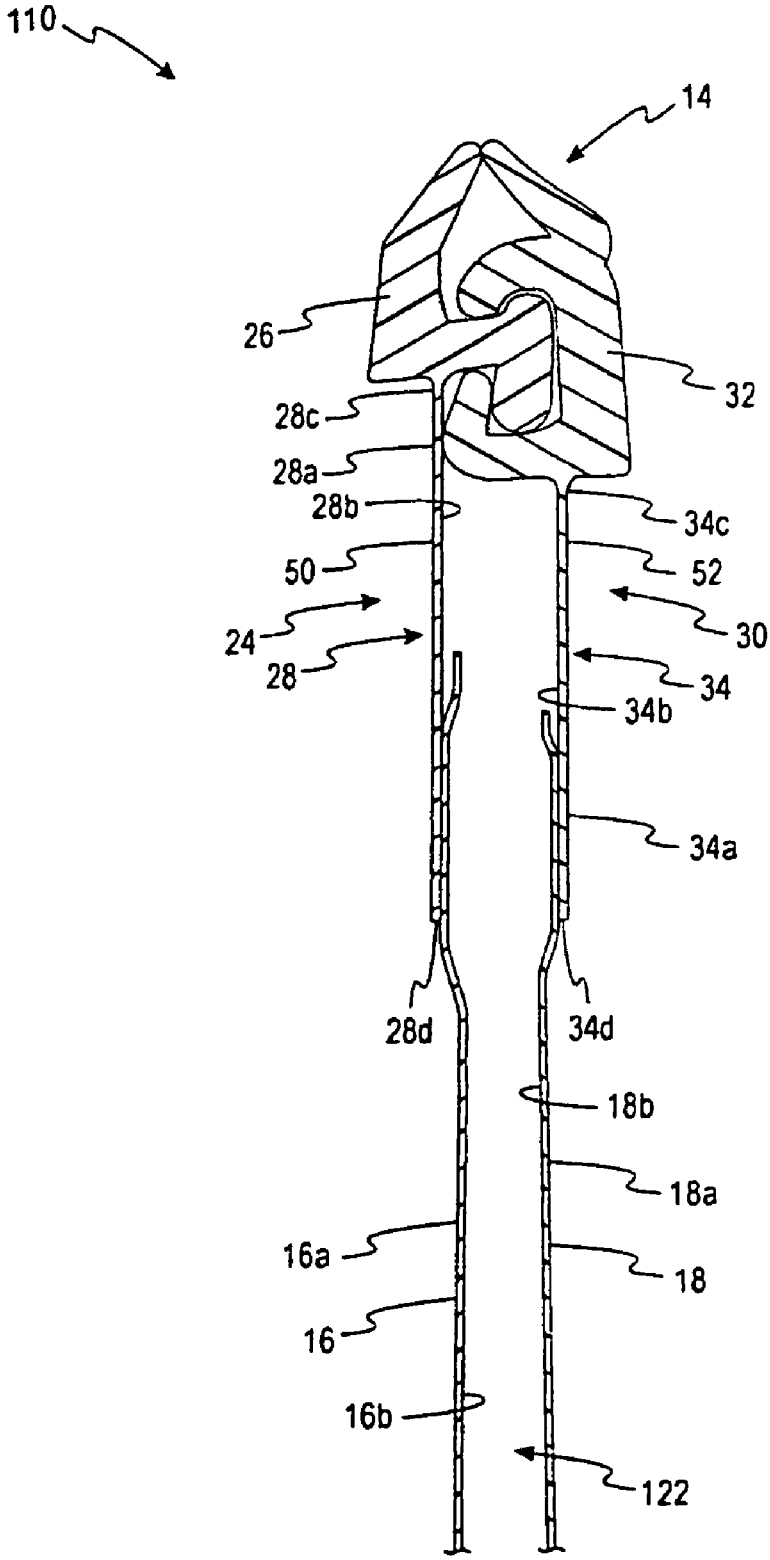
FIG. 3*a* is a sectional view of a mouth portion of a reclosable package or bag according to another embodiment of the present invention.
Figure 3B:
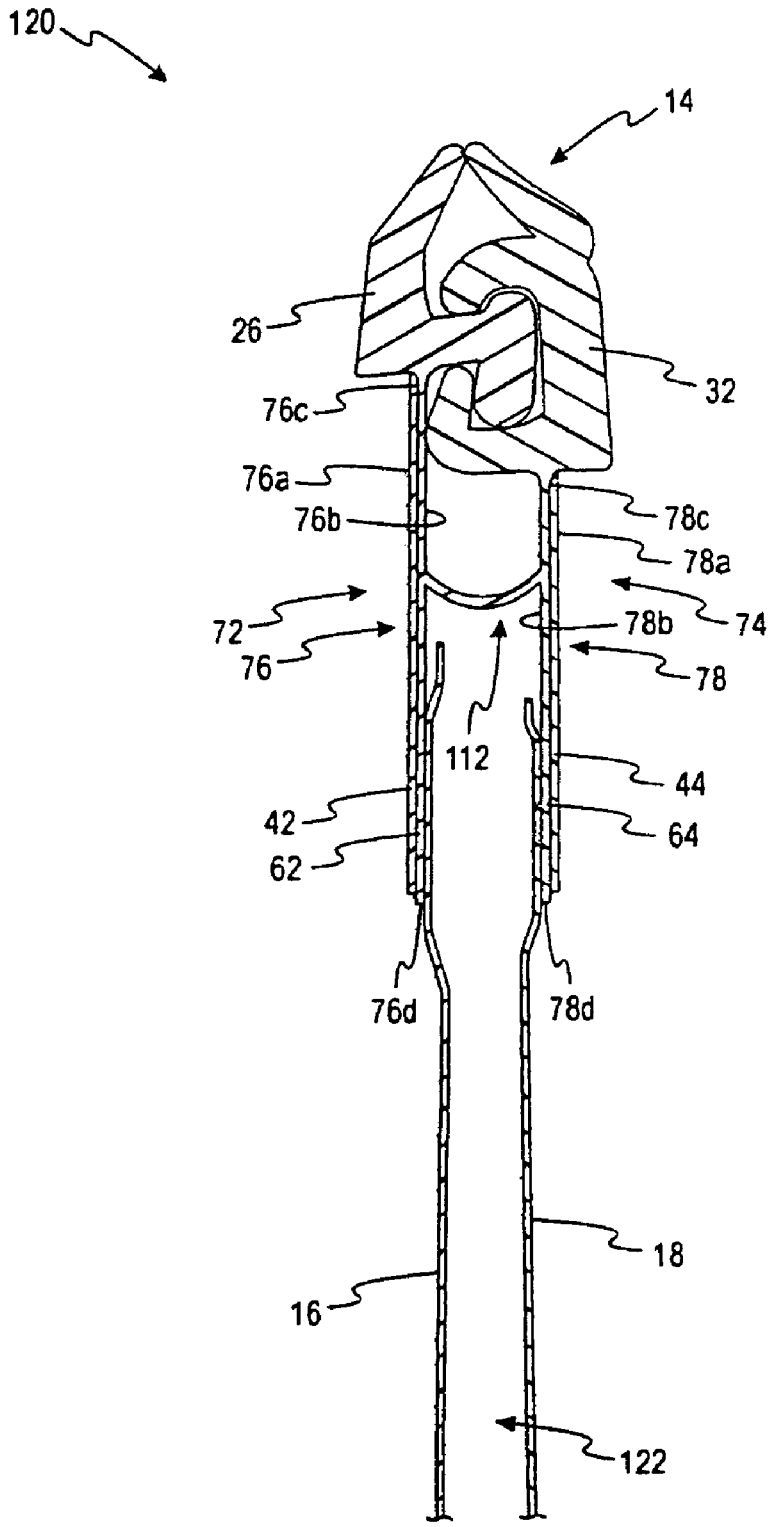
FIG. 3*b* is a sectional view of a mouth portion of a reclosable package or bag according to still another embodiment of the present invention.
Figure 3C:
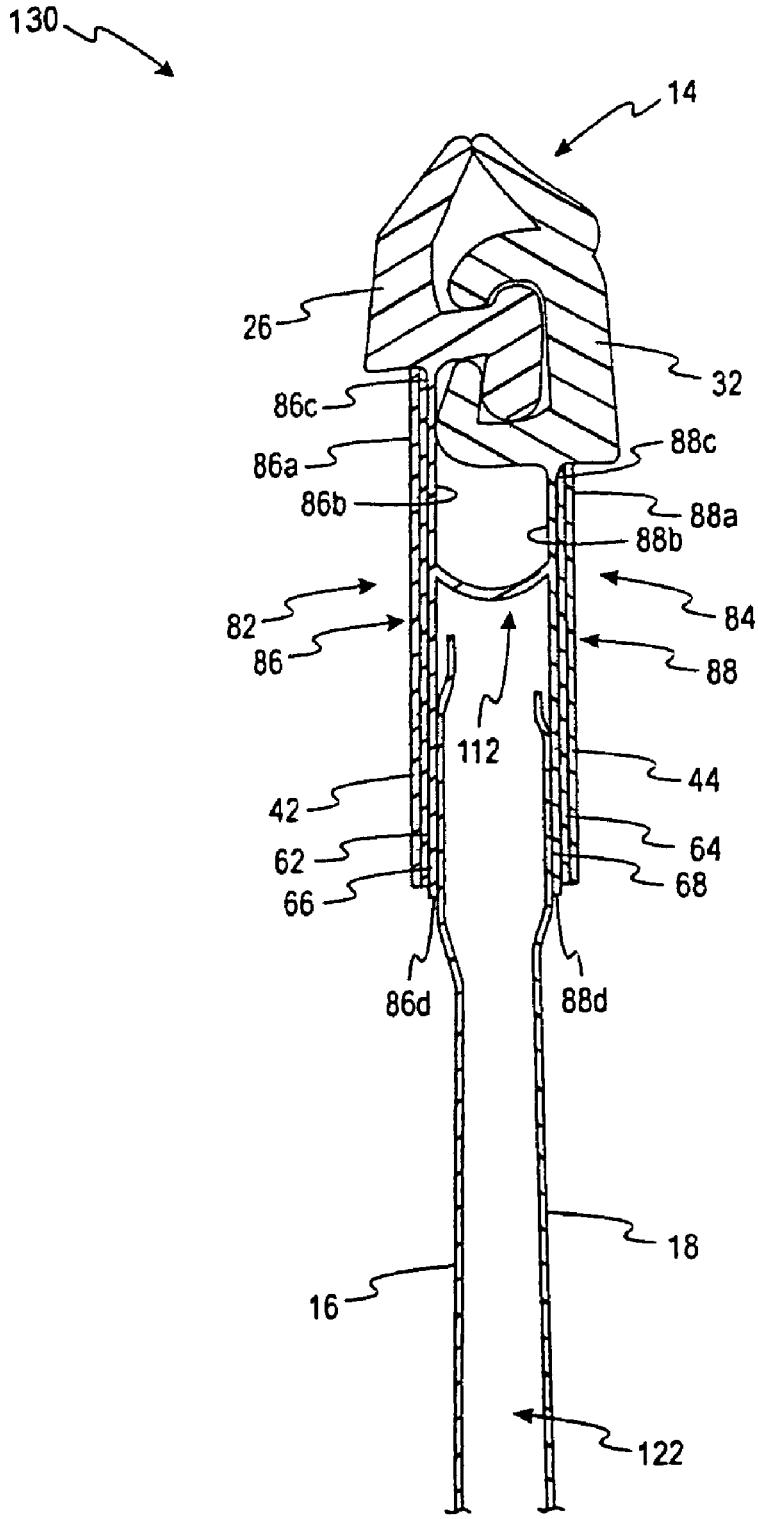
FIG. 3*c* is a sectional view of a mouth portion of a reclosable package or bag according to a further embodiment of the present invention.

As shown in packages 70, 80 of FIGS. 1*c*-1*d*, first fin portions 76, 86 and second fin portions 78, 88 can contain multiple layers. Turning first to the illustrated embodiment of FIG. 1*c*, the first track 72 has the first profile 26 and a first fin portion 76. The first fin portion 76 has a layer containing an active agent 62 and a barrier layer 42. The active agent can be one of the previously mentioned active agents. The barrier layer 42 at least inhibits the transfer of, but is preferably substantially impermeable to, water vapor and active agents, and, in some embodiments, oxygen, nitrogen, carbon dioxide, or combinations thereof. (Features 76*a*, 76*b*, 76*c*, 76*d*, 78*a*, 78*b*, 78*c*, and 78*d* in FIGS. 1*c* and 3*b* and features 86*a*, 86*b*, 86*c*, 86*d*, 88*a*, 88*b*, 88*c*, and 88*d* in FIGS. 1*d* and 3*c* are analogous to features 28*a*, 28*b*, 28*c*, 28*d*, 34*a*, 34*b*, 34*c*, and 34*d* in FIG. 1*a*, respectively.)

The second track 74 has the second profile 32 and a second fin portion 78. The second fin portion 78 of FIG. 1*c* has a layer containing an active agent 64 and a barrier layer 44. The active agent 64 can be one of the previously mentioned active agents. The barrier layer 44 at least inhibits the transfer of, but is preferably substantially impermeable to water vapor and active agents, and, in some embodiments, oxygen, nitrogen, carbon dioxide, or combinations thereof.

In the embodiment depicted in FIG. 1*c*, the layer with active agent 62 is closest to the interior space 22. It is also contemplated that the barrier layer 42 can be located closest to the interior space 22. Likewise, the layer with active agent 64 is closest to the interior space 22. It is also contemplated that the barrier layer 44 can be located closest to interior space 22.

Referring to FIG. 1*d*, first track 82 has the first profile 26 and a first fin portion 86. The first fin portion 86 comprises the layer containing an active agent 62, the barrier layer 42, and a diffusion layer 66. The active agent can be one of the previously mentioned active agents. The barrier layer 42 at least inhibits the transfer of, but is preferably substantially impermeable to, water vapor and active agents, and, in some embodiments, oxygen, nitrogen, carbon dioxide, or combinations thereof. The diffusion layer 66 is located on the opposite side of the layer with the active agent 62 as the barrier layer 42.

The second track 84 has the second profile 32 and a second fin portion 88. The second fin portion 88 of FIG. 1*d* has the layer containing active agent 64, the barrier layer 44, and a diffusion layer 68. The active agent can be one of the previously mentioned active agents. The barrier layer 44 at least inhibits the transfer of, but is preferably substantially impermeable to, water vapor and active agents, and, in some embodiments, oxygen, nitrogen, carbon dioxide, or combinations thereof. The barrier layer 44 can comprise one of the previously mentioned barrier materials. The diffusion layer 68 is located on the opposite side of the layer with the active agent 64 as the barrier layer 44.

The diffusion layers 66, 68 of the respective first and second fin portions 86, 88 can be made of a suitable material that allows the active agent to reach the interior of the reclosable package in a relatively quick fashion. Thus, materials providing permeation of water, water vapor, oxygen, nitrogen, carbon dioxide, ethylene, volatile actives or nonvolatile active agents can be used for the diffusion layer. Examples of a diffusion layers include polymers, copolymers, blends, extrusions, co-extrusions, coatings or laminations of: low density polyethylene (LDPE), linear low density polyethylene (LLDPE), very low density polyethylene (VLDPE), metallocene (mPE), polypropylene (PP), acrylonitrile butadiene styrene (ABS), polyamide 6, polyamide 66 and their copolyamides, poly vinyl chloride (PVC), acrylic, polybutylene terephthalate (PBT), thermoplastic polyester (TPE), ethylene/ethyl acrylate (EEA), ethylene/vinyl acetate (EVA), polystyrene (PS), high impact polystyrene (HIPS), modified polystyrene, ethylene-vinyl alcohol (EVAL or EVOH), polyacrylic acid (PAA), polylactic acid (PLA), filled polymers, hydrophilic nanocomposite polymers, polymethyl methacrylate (PMMA), thermoplastic elastomers, polydimethylsiloxane (PDMS), polymethylpentene (PMP), polyvinyl acetate (PVA), polyvinyl alcohol (PVAL), and cellulose acetate (CA).

As will be understood by those of ordinary skill in the art, the same type of polymer material can be used in forming either the matrix, barrier or diffusion layer, depending on the percentage ratio of the material in the layer composition, the quantity of the material in the layer composition (e.g., the thickness of the layer composition), and/or the method of fabrication. Thus, the use of a particular polymer material as a component for the matrix, barrier, or diffusion layer depends on its amount and manner of use.

The diffusion layers 66, 68 assist in controlling the amount of active agent that is in communication with the interior space 22. In particular, the diffusion layer controls the amount of the active agent released into the interior of the package such that the amount entering the interior of the package is equal to or greater than the amount lost to outside the package. Thus, controlling the amount of active agent that is in communication with the interior space improves the pre-use shelf life of food products, perishables, or other contents in the reclosable package by ensuring continued presence of an adequate amount of the active agent within the package. The diffusion layer also serves to ensure the proper release rate of the active agent when the reclosable package is in use.

In the embodiment depicted in FIG. 1*d*, the diffusion layer 66 is closest to interior space 22. It is also contemplated that the barrier layer 42 can be located closest to the interior space 22. Likewise, the diffusion layer 68 is closest to interior space 22. It is also contemplated that the barrier layer 44 can be located closest to the interior space 22.

The tracks, profiles, fin portions, and one-time breakable element typically 25 comprise one or more polymeric resins. The tracks, profiles, fin portions, and one-time breakable element can be independently comprised of one or more polyolefins including, but not limited to, polyethylenes, polypropylenes, or combinations thereof. Some non-limiting types of polyethylenes include low density polyethylenes (LDPE), linear low density polyethylenes (LLDPE), high density polyethylenes (HDPE), medium density polyethylenes (MDPE) and combinations thereof. Other non-limiting examples include plastomers, elastomers, ethylene vinyl acetates (EVA), ethyl methacrylates, polymethylpentene copolymers, polyisobutylenes, polyolefin ionomers, cyclic olefin copolymers (COCs), or combinations thereof, including with polyethylenes and/or polypropylenes.

One or more of the tracks, profiles, fin portions, and/or one-time breakable element can be made from multiple layers. The multiple layers of the tracks, profiles, fin portions and one-time breakable element can be independently formed by coextruding or other processes such as coating or laminating.

The opposing films forming the opposing body panels 16, 18 of the polymeric package can be made of one or more polymeric resins. The opposing body panels 16, 18 can be comprised of one or more polyolefins including, but not limited to, polyethylenes, polypropylenes, or combinations thereof. Some non-limiting types of polyethylenes include low density polyethylenes (LDPE), linear low density polyethylenes (LLDPE), high density polyethylenes (HDPE), medium density polyethylenes, (MDPE) and combinations thereof. Other non-limiting examples include plastomers, elastomers, ethylene vinyl acetates (EVA), ethyl methacrylates, polymethylpentene copolymers, polyisobutylenes, polyolefin ionomers, cyclic olefin copolymers, (COCs) or combinations thereof, including with polyethylenes and/or polypropylenes.

Furthermore, the opposing body panels 16, 18 of the present invention can be made of multiple layers including those layers joined by coextrusion or other processes such as coating or laminating. It is further possible to incorporate pigments, metallic components, paper, and/or paper/plastic composites into or on the layer(s) of the polymeric bags of the present invention.

The optional slider mechanism 36 can be formed from suitable polymeric 25 materials such as, for example, nylon, polypropylene, polyethylene, polystyrene, copolymers of polyethylene and polypropylene, polycarbonates, polyesters, polyacetals, or acrylic-butadiene-styrene copolymers. Especially preferred components for making the slider mechanism 36 are polypropylenes, polycarbonates, or polyesters. The slider mechanism 36 can be formed by injection molding.

Similarly, the opposing body panels 16, 18 (such as depicted in FIGS. 1*a*-1*d*, 3*a*-3*c*) can form a barrier layer that is substantially impermeable to at least water vapor and active agents, and, in some embodiments, also to oxygen, nitrogen, carbon dioxide, or combinations thereof. The opposing body panels 16, 18 can thus include similar materials as described above in forming the fin portion barrier layers 42, 44. The opposing body panels 16, 18 can provide a barrier layer located on an exterior or interior surface of the packages.

The opposing body panels 16, 18 can be made of multiple layers. For example, the opposing body panels 16, 18 can include a tie layer that attaches to the fin portions. The tie layer can be made from various materials such as ethylene vinyl acetate (EVA), anhydride modified polyolefins, anhydride modified ethylene-acrylates, anhydride modified EVAs, acid modified EVAs, acid modified ethylene-acrylates, amorphous polyolefin-modified EVA polymers, or combinations thereof. Some examples of anhydride modified polyolefins include anhydride modified high density polyethylene (HDPE), anhydride modified low density polyethylene (LDPE), and anhydride linear low density polyethylene (LLDPE).

An example of a three layer body panel (not shown) includes a first layer having the same materials as described above in making the fin portion barrier layers 42, 44, a tie layer, and a third layer made of polyolefin(s), such as an LDPE, an HDPE, an LLDPE, or combinations thereof. In this embodiment, the first layer would be preferably located on the interior of the body panel with the tie layer being located between the first and third layers. Such body panels would be used in a similar manner as body panels 16, 18 described above.

The components of the reclosable closure arrangement (such as the tracks having integrally formed interlocking profiles and fin portions) can be attached to the body panels of the package by processes such as heat sealing, welding (e.g., ultrasonic welding), or blocking. The process utilized depends on the materials from which the bag and the reclosable closure arrangement are made. Specifically, heat sealing is a process in which materials are fused or melted together. Welding is a process where an intermediate third material is utilized to "glue" similar materials to each other. Blocking is a process where at least sufficient pressure and optional temperature increases result in intimate surface contact adhesion of layers without sealing.

The fin portions can be attached in a different manner with respect to the body panels than depicted in FIGS. 1*a*-1*d*. Referring to FIGS. 3*a*-3*c*, the mouth portions of reclosable packages 110, 120, 130 are shown including the pair of first and second opposing body or wall panels 16, 18 that make up the package body and define an interior space 122. Referring to FIG. 3*a*, connected to the first body panel 16 is the first track 24 having the first profile 26 and the first fin portion 28 extending generally downward from the first profile 26. The first body panel 16 includes the outer surface 16*a* and the inner surface 16*b*. The first fin portion 28 has the outer surface 28*a* and the inner surface 28*b*. Connected to the second body panel 18 is the second track 30 having the second profile 32 and the second fin portion 34 extending generally downward from the second profile 32. The second body panel 18 has the outer surface 18*a* and the inner surface 18*b*. The second fin portion 34 has the outer surface 34*a* and the inner surface 34*b*. The outer surface 16*a* is attached to the inner surface 28*b*. The outer surface 18*a* is attached to the inner surface 34*b*. The first and second profiles 26, 32 are releasably engageable with each other to provide a reclosable seal to the package 110.

In the illustrated embodiment of FIG. 3*a*, the first fin portion 28 includes the active agent 50. More specifically, the active agent 50 can be one of the previously mentioned active agents. The second fin portion 34 has the active agent 52. More specifically, the active agent 52 can be one of the previously mentioned freshness-extension agents.

The active agent 50 can be extruded with the first fin portion 28. The first fin portion 28 can be impregnated with active agent 50. It is also contemplated that active agent 50 can be sprayed, brushed, coated, laminated, or stamped onto the first fin portion 28.

Similarly, the active agent 52 can be extruded with the second fin portion 34. The second fin portion 34 can be impregnated with active agent 52. It is also contemplated that active agent 52, can be sprayed, brushed, coated, laminated, or stamped onto the second fin portion 34.

As shown in FIGS. 3*b*-3*c*, the first fin and second fin portions can contain multiple layers. Turning first to the illustrated embodiment of FIG. 3*b*, the reclosable package 120 includes the first track 72 and the second track 74. The first track 72 includes the first profile 26 and the first fin portion 76. The first fin portion 76 has the layer 62 containing an active agent and the barrier layer 42. The active agent can be one of the previously mentioned active agents. The barrier layer 42 is preferably substantially impermeable to water vapor and active agents, and in some embodiments, to oxygen, nitrogen, carbon dioxide, or combinations thereof.

The second track 74 includes the second profile 32 and the second fin portion 78. The second fin portion 78 of FIG. 3*b* has the layer containing an active agent 64 and the barrier layer 44. The active agent can be one of the previously mentioned active agents. The barrier layer 44 is preferably substantially impermeable to water vapor and active agents, and, in some embodiments, to oxygen, nitrogen, carbon dioxide, or combinations thereof.

In the embodiment depicted in FIG. 3*b*, the layer with active agent 62 is closest to the interior space 122. It is also contemplated that the barrier layer 42 could be located closest to the interior space 122. Likewise, the layer with active agent 64 is closest to the interior space 122. It is also contemplated that the barrier layer 44 could be located closest to the interior space 122.

Reclosable package 120 of FIG. 3*b* is shown with an optional one-time breakable element 112. The one-time breakable element 112 is designed to serve the same purpose of the one-time breakable element 12 of FIGS. 1*b*-1*d*.

Referring to FIG. 3*c*, a reclosable package 130 is shown with the first track 82 and the second track 84. The first track 82 has the first profile 26 and the first fin portion 86. The first fin portion 86 comprises the layer containing active agent 62, the barrier layer 42, and the diffusion layer 66. The active agent can be one of the previously mentioned active agents. The barrier layer 62 is preferably substantially impermeable to water vapor and active agents, and, in some embodiments, to oxygen, nitrogen, carbon dioxide, or combinations thereof. The barrier layer 42 can comprise one of the previously mentioned barrier materials.

The diffusion layer 66 can comprise one of the previously mentioned diffusion layer materials. The diffusion layer assists in controlling the amount of active agent that is in communication with the interior space 122. The diffusion layer 66 is located on the opposite side of the layer having active agent 62 as the barrier layer 42. Controlling the amount of active agent that is in communication with the interior space improves the pre-use shelf life of food products, perishables, or other contents in the reclosable package. The diffusion layer also serves to ensure the proper release rate of the active agent when the reclosable package is in use.

The second track 84 having the second profile 32 and the second fin portion 88 is also shown in FIG. 3*c*. The second fin portion 88 of FIG. 3*c* has the layer containing a active agent 64, the barrier layer 44, and the diffusion layer 68. The active agent can include one of the previously mentioned active agents.

The barrier layer 44 is preferably substantially impermeable to water vapor and active agents, and, in some embodiments, to oxygen, nitrogen, carbon dioxide, or combinations thereof. The barrier layer 44 can comprise one of the previously mentioned barrier materials. The diffusion layer 68 can comprise one of the previously mentioned diffusion layer materials. The diffusion layer assists in controlling the amount of the active agent that is in communication with the interior space 122. The diffusion layer 68 is located on the opposite side of the layer containing active agent 64 as the barrier layer 44. Controlling the amount of active agent that is in communication with the interior space improves the pre-use shelf life of food products, perishables, or other contents in the reclosable package. The diffusion layer also serves to ensure the proper release rate of the active agent when the reclosable package is in use.

In the embodiment depicted in FIG. 3*c* the diffusion layer 66 is closest to the 25 interior space 122. It is also contemplated that the barrier layer 42 can be located closest to interior space 122. Likewise, the diffusion layer 68 is closest to interior space 122. It is also contemplated that the barrier layer 44 can be located closest to interior space 122.

Alternatively, an adhesive seal can be utilized as a fastener or reclosable element of the present invention. Such seals employ a resealable adhesive-type substance that is applied to either one or both of the films forming the package. The adhesive can alternatively be applied to an intermediary base strip. It is contemplated that other closure arrangements, besides adhesive seals and zippers, can be used in the embodiments of the present invention.

Reclosable packages 10 and 110 shown in FIGS. 1*a* and 3*a* can be used for consumer storage of food products or other perishables, such as leftover food products. During a method of operation of reclosable package 10, one or more food products or perishables are placed in the interior 22 of the package 10 and the fastener 14 is placed in a closed position. The humidity or moisture level present in the food products activates the freshness-extension agent 50 or 52 as the products travel in the vicinity of the active agent and while the products remain disposed in the interior, thereby inhibiting spoilage of the food products. Opening the package 10, i.e., placing the reclosable fastener 14 in an open position, also activates the agent 50 or 52 by allowing air to enter the interior 22.

As shown in FIGS. 1*b*, 1*c*, 3*b*, and 3*c*, reclosable packages 60, 120 and 70, 130 differ with respect to the placement of active agents relative to breakable elements. For example, the active agents 50, 52 in package 60 of FIG. 1*b* are disposed above the breakable element 12 and therefore spaced from the interior prior to use, while the active agents 62, 64 in package 70 are disposed above and below the breakable element 12. Generally, the active agents in a package can be disposed above, above and below, or below the one-time breakable element.

Packages with breakable elements can be used for consumer storage of food products or other perishables. During a method of operation of reclosable packages 60 or 70, the breakable elements 12 are broken, perishables are placed in the interior 22 of the packages 60 and 70, and the packages 60 and 70 are resealed along the breakable elements 12 and closed along the fasteners 14. If the freshness-extension agents are disposed above the breakable element, similar to reclosable package 60, the freshness-extension agents can be activated on travel of food products in vicinity of the agent (e.g., through the mouth of the package during the initial placement of the perishable products into the interior) and on entry of air into the interior (e.g., during an opening or reopening of the package). If the freshness-extension agents are disposed above and below the breakable element, similar to reclosable package 70, the freshness-extension agents can be activated on travel of food products in the vicinity of agent, while the food products remain disposed in the interior, and on entry of air into the interior. Generally, a package with a freshness-extension agent disposed below a breakable element is preferred for consumer use, because the agent is not exposed to air until the package is opened, thereby increasing the shelf life of the agent.

Packages with breakable elements are also suitable for different types of commercial form, fill, and seal food packaging operations ("FFS operations"). Such packages can be used in different types of FFS operations depending on the placement of the freshness-extension agents relative to the breakable elements. A package with a freshness-extension agent disposed above a one-time breakable element is suitable for FFS operations in which an interior of a package with food products is substantially evacuated during closure of the package via the one-time breakable element. Since the food products are disposed in an evacuated environment, spoilage is inhibited within the interior of the package prior to the breakable of the one-time breakable element. Once opened, however, the freshness-extension agent inhibits spoilage, hence obviating a freshness-extension agent below the one-time breakable element. In contrast, a package with a freshness agent disposed below or above and below a one-time breakable element is suitable for FFS operations in which an interior of a package containing food products is either not evacuated or only partially evacuated during closure of the package via the one-time breakable element. The freshness-extension agent disposed below the one-time breakable element can inhibit spoilage of the food products disposed in the interior of the package and thereby enhance shelf life. Such an arrangement of freshness-extension agent and one-time breakable element is suitable for food products known to have high rates of spoilage, like cheese. Generally, a package with a freshness-extension agent disposed above a breakable element is preferred for commercial operations in which food products are disposed in an evacuated packages, because the agent is not used until the package is opened.

The packages can be formed of any suitable material, such as by a thermoplastic material suitable for storing or collecting items, including perishables storage. This, of course, includes common-sized reclosable packages such as pint storage and freezer bags, quart storage and freezer bags, and gallon storage and freezer bags. The reclosable packages are typically formed from polymeric materials such as polyolefinic materials. Non-limiting examples of polyolefinic materials include polyethylenes, polypropylenes, polystyrene, and combinations thereof. For example, some types of polyethylenes materials include high density polyethylenes (HDPE), low density polyethylenes (LDPE), linear low density polyethylenes (LLDPE), and combinations thereof. It is also contemplated that materials such as plastomers, elastomers, ethylene vinyl acetates (EVA), ethyl methacrylates, polymethylpentene copolymers, polyisbutylenes, polyolefin ionomers, cyclic olefin copolymers (COCs) or combinations thereof, including polyethylenes, and/or polypropylenes may be used in forming the reclosable packages of the present invention. The thicknesses of the reclosable packages can vary in the present invention, but are generally from about 0.5 mil to about 5 mils and, more specifically, from about 1 mil to about 3 mils.

As previously described herein, the active agents of the present invention can be used in combination with fin portions of a fastener of a reclosable package. Alternatively and/or in combination, the active agents of the present invention can be used in combination with a body panel of the reclosable package, as further described in co-pending U.S. patent application Ser. No. 11/055,075, the contents of which application are expressly incorporated by reference herein in its entirety.

It is contemplated that additional or alternative layers can be used in forming the reclosable packages shown and described herein. For example, a freshness-extension enhancing layer can be added or incorporated into a body panel in lieu of or in addition to use on the fin portion. A freshness-extension enhancing layer can enhance delivery of a freshness-extension agent with increasing humidity. Increasing humidity often results in a corresponding increase in bacteria growth that results in increased food spoilage. One example of a freshness-extension enhancing layer is polyvinyl alcohol (PVOH).

While the disclosed packages with active agents have been shown and described with reference to the illustrated embodiments, those of ordinary skill in the art will recognize and/or be able to ascertain many equivalents to those embodiments. Such equivalents are encompassed by the scope of the present disclosure and the appended claims.

For example, those of ordinary skill in the art will understand that the present invention has applications to various types of packages and containers, including unreclosable bags and liners, rigid containers such as rigid trash containers, plastic containers and lunch boxes, and food packaging wraps and foils. Similarly, those of ordinary skill in the art will understand that the present invention has applications to agents other than freshness-extension agents, such as odor management agents and other agents providing a desired function or effect in a package or the contents disposed therein.

Unless otherwise provided, when the articles "a" or "an" are used herein to modify a noun, they can be understood to include one or more than one of the modified noun.

What is claimed is:

1. A reclosable package comprising:

a pair of opposing body panels joined together along a pair of opposing sides and a bottom bridging the sides, the body panels defining a mouth opposite the bottom;

a reclosable fastener extending along the mouth and including a pair of polymeric tracks, each of the tracks including a mating element and a fin portion, the mating elements being releasably engageable to each other, each of the fin portions extending generally downwardly from the reclosable element towards the bottom of the reclosable package; and an antimicrobial extruded or impregnated in at least one of the fin portions for release in a gaseous form into an interior of the reclosable package.

2. The reclosable package of claim 1, wherein the antimicrobial is extruded with the at least one of the fin portions.

3. The reclosable package of claim 2, wherein the antimicrobial is distributed in the form of microcapsules in the at least one of the fin portions.

4. The reclosable package of claim 1, further comprising: a means for selectively initiating release of the antimicrobial.

5. The reclosable package of claim 1, wherein the antimicrobial is activated by humidity.

6. The reclosable package of claim 1, further comprising: a one-time breakable element extending between the fin portions and disposed between the interior and the reclosable fastener.

7. The reclosable package of claim 6, wherein the antimicrobial is disposed above the one-time breakable element.

8. The reclosable package of claim 6, wherein the antimicrobial is disposed below the one-time breakable element.

9. The reclosable package of claim 1, further comprising: a barrier layer associated with at least one of the body panels to define a barrier environment for the interior.

10. The reclosable package of claim 1, wherein the antimicrobial is included in an antimicrobial layer, the reclosable package further comprising: a barrier layer associated with the at least one of the fin portions.

11. The reclosable package of claim 10, wherein the antimicrobial layer is located closer to the interior than the barrier layer.

12. The reclosable package of claim 1, further comprising: a diffusion layer associated with the at least one of the fin portions, the diffusion layer being adjacent to an antimicrobial layer including the antimicrobial.

13. The reclosable package of claim 12, wherein the diffusion layer is located closer to the interior than the antimicrobial layer.

14. The reclosable package of claim 1, wherein the antimicrobial is selected from the group consisting of carbon dioxide, diacetyl, chlorine dioxide, allyl isothiocyanate (AIT), ethyl alcohol, carvacrol, cinnamic aldehyde, methyl j asmonate, and mixtures thereof.

15. A reclosable package comprising:

a pair of opposing body panels joined together along a pair of opposing sides and a bottom bridging the sides, the body panels defining a mouth opposite the bottom;

a reclosable fastener extending along the mouth and including a pair of polymeric tracks, each of the tracks including a mating element and a fin portion, the mating elements being releasably engageable to each other, each of the fin portions extending generally downwardly from the reclosable element towards the bottom of the reclosable package;

an antimicrobial agent extruded or impregnated in at least one of the fin portions for release in a gaseous form into an interior of the reclosable package; and wherein the antimicrobial agent includes an isothiocyanate compound.

16. The reclosable package of claim 15, wherein the antimicrobial agent further includes an acid.

17. The reclosable package of claim 15, wherein the antimicrobial agent further includes a fragrant.

18. A reclosable package comprising:

a first opposing body panel having an inner surface and an outer surface;

a second opposing body panel having an inner surface and an outer surface, the first and second body panels being joined along a pair of opposing sides and a bottom bridging the sides so as to form an open mouth at one end, the joined first and second body panels forming an interior space; and a reclosable polymeric seal extending along the one end of the respective inner surfaces of the first and second opposing body panels, the reclosable polymeric seal including a first polymeric track and a second polymeric track, the first polymeric track including a first fin portion and a first mating element, the first fin portion extending generally downwardly from the first reclosable element toward the bottom, the first fin portion having at least a first layer having an antimicrobial extruded or impregnated therein for release in a gaseous form into an interior of the reclosable package and a second layer being a barrier layer, the second polymeric track including a second fin portion and a second mating element, the second fin portion extending generally downwardly from the second reclosable element toward the bottom, the second fin portion having at least a third layer having an antimicrobial extruded or impregnated therein for release in a gaseous form into an interior of the reclosable package and a fourth layer being a barrier layer, the first mating element and the second mating element being releasably engageable to each other.

19. The reclosable package of claim 18, wherein the antimicrobial is selected from the group consisting of carbon dioxide, diacetyl, chlorine dioxide, allyl isothiocyanate (AIT), ethyl alcohol, carvacrol, cinnamic aldehyde, methyl jasmonate, and mixtures thereof.

* * * * *